US008336776B2

(12) United States Patent
Horvath et al.

(10) Patent No.: US 8,336,776 B2
(45) Date of Patent: Dec. 25, 2012

(54) AIMING SYSTEM FOR WEAPON

(75) Inventors: Anthony Horvath, Temperance, MI (US); Aaron Adkins, White Lake, MI (US); Richard Willard, San Diego, CA (US); Paul Stoltz, Boulder, CO (US)

(73) Assignee: Trijicon, Inc., Wixom, MI (US)

( * ) Notice: Subject to any disclaimer, the term of this patent is extended or adjusted under 35 U.S.C. 154(b) by 0 days.

(21) Appl. No.: 13/112,365

(22) Filed: May 20, 2011

(65) Prior Publication Data

US 2012/0000979 A1 Jan. 5, 2012

Related U.S. Application Data

(60) Provisional application No. 61/360,008, filed on Jun. 30, 2010.

(51) Int. Cl.
*G06F 19/00* (2006.01)
*G06G 7/80* (2006.01)

(52) U.S. Cl. ..... 235/407; 235/400; 235/404; 235/414; 235/417

(58) Field of Classification Search ..... 235/400, 235/404, 407, 411, 414, 417
See application file for complete search history.

(56) References Cited

U.S. PATENT DOCUMENTS

| | | | |
|---|---|---|---|
| 2,545,655 | A | 3/1951 | Doyle et al. |
| 2,577,785 | A | 12/1951 | Lyon |
| 2,782,988 | A | 2/1957 | Mikol |
| 3,575,085 | A | 4/1971 | McAdam, Jr. |
| 3,604,897 | A | 9/1971 | McAdam, Jr. et al. |
| 3,739,152 | A | 6/1973 | Frohock, Jr. et al. |
| 3,743,818 | A | 7/1973 | Marasco et al. |
| 4,326,340 | A | 4/1982 | Blomqvist et al. |
| 4,494,198 | A | 1/1985 | Smith et al. |
| 4,531,052 | A | 7/1985 | Moore |
| 4,606,256 | A | 8/1986 | De'Ath |
| 4,777,352 | A | 10/1988 | Moore |
| 4,965,439 | A | 10/1990 | Moore |
| 4,975,705 | A | 12/1990 | Gellekink et al. |
| 4,993,833 | A | 2/1991 | Lorey et al. |
| 5,026,158 | A | 6/1991 | Golubic |
| 5,035,472 | A | 7/1991 | Hansen |
| 5,036,748 | A | 8/1991 | Pendry |
| 5,341,142 | A | 8/1994 | Reis et al. |
| 5,375,072 | A | 12/1994 | Cohen |
| 5,392,688 | A | 2/1995 | Boutet et al. |

(Continued)

FOREIGN PATENT DOCUMENTS

DE 3837922 A1 5/1990

(Continued)

OTHER PUBLICATIONS

European Search Report for Application No. EP 11 00 5291, dated Sep. 29, 2011.

(Continued)

*Primary Examiner* — Tuyen K Vo
(74) *Attorney, Agent, or Firm* — Harness, Dickey & Pierce, P.L.C.

(57) ABSTRACT

An aiming system for use with a weapon is provided and may include a processor, at least one sensor in communication with the processor, and a memory in communication with the processor. The aiming system may also include a display in communication with the processor that displays a corrected-aiming point based on at least one simulated bullet trajectory and at least one simulated bullet impact location determined by the processor.

21 Claims, 24 Drawing Sheets

U.S. PATENT DOCUMENTS 5,652,651 A 7/1997 Dunne
5,686,690 A 11/1997 Lougheed et al.
5,771,623 A 6/1998 Pernstich et al.
5,822,713 A 10/1998 Profeta
5,824,942 A 10/1998 Mladjan et al.
5,831,718 A 11/1998 Desai et al.
5,988,038 A * 11/1999 Feintuch ..... 89/1.13
6,025,908 A 2/2000 Houde-Walter
6,247,259 B1 6/2001 Tsadka et al.
6,252,706 B1 6/2001 Kaladgew
6,269,581 B1 8/2001 Groh
6,449,892 B1 9/2002 Jenkins
6,499,382 B1 * 12/2002 Lougheed et al. ..... 89/41.05
6,516,699 B2 2/2003 Sammut et al.
6,615,531 B1 9/2003 Holmberg
6,769,347 B1 * 8/2004 Quinn ..... 89/41.05
6,813,025 B2 11/2004 Edwards
6,819,495 B2 11/2004 Shani et al.
6,871,439 B1 * 3/2005 Edwards ..... 42/84
6,955,296 B2 10/2005 Lusher et al.
6,988,331 B2 1/2006 Holmberg
7,089,845 B2 8/2006 Friedli et al.
7,100,321 B2 9/2006 Holmberg
7,121,036 B1 10/2006 Florence et al.
7,124,531 B1 10/2006 Florence et al.
7,171,776 B2 2/2007 Staley, III
7,269,920 B2 9/2007 Staley, III
7,292,262 B2 11/2007 Towery et al.
7,325,318 B2 2/2008 Roes
7,325,353 B2 2/2008 Cole et al.
7,350,329 B1 4/2008 Bell et al.
7,421,816 B2 9/2008 Conescu
7,434,346 B2 10/2008 Scherpf
7,500,423 B2 3/2009 Strand
7,516,571 B2 4/2009 Scrogin et al.
7,574,825 B2 8/2009 Lacorte
7,654,029 B2 2/2010 Peters et al.
7,658,031 B2 2/2010 Cross et al.
7,836,626 B2 11/2010 Shepherd
7,937,878 B2 5/2011 Sammut et al.
7,990,523 B2 8/2011 Schlierbach et al.
8,033,464 B2 * 10/2011 Windauer et al. ..... 235/404
8,046,951 B2 11/2011 Peters et al.
8,051,597 B1 11/2011 D'Souza et al.
8,120,992 B2 * 2/2012 Kuklinski et al. ..... 367/118
8,152,064 B2 4/2012 Svane et al.
2002/0129535 A1 9/2002 Osborn, II
2003/0010190 A1 1/2003 Sammut et al.
2003/0136253 A1 7/2003 Moser et al.
2003/0163943 A1 9/2003 Holmberg
2004/0020099 A1 2/2004 Osborn, II
2004/0074132 A1 4/2004 Jirina
2004/0079018 A1 4/2004 Holmberg
2005/0195385 A1 9/2005 Holmberg
2005/0198885 A1 9/2005 Staley
2005/0252062 A1 11/2005 Scrogin et al.
2006/0005447 A1 1/2006 Lenner et al.
2006/0010760 A1 1/2006 Perkins et al.
2006/0010761 A1 1/2006 Staley
2006/0010762 A1 1/2006 Lin et al.
2006/0048432 A1 3/2006 Staley
2006/0254116 A1 11/2006 Holmberg
2007/0044364 A1 3/2007 Sammut et al.
2007/0113460 A1 5/2007 Potterfield et al.
2007/0119296 A1 5/2007 Niv et al.
2007/0132982 A1 6/2007 Vermillion et al.
2007/0137088 A1 6/2007 Peters et al.
2007/0137090 A1 6/2007 Conescu
2007/0137091 A1 6/2007 Cross et al.
2007/0209268 A1 9/2007 Birurakis et al.
2007/0234626 A1 10/2007 Murdock et al.
2007/0258082 A1 11/2007 Vermillion et al.
2007/0277421 A1 12/2007 Perkins et al.
2008/0030466 A1 2/2008 Keates et al.
2008/0039962 A1 2/2008 McRae
2008/0048033 A1 * 2/2008 Quinn ..... 235/411
2008/0060248 A1 3/2008 Pine et al.
2008/0098640 A1 5/2008 Sammut et al.
2008/0163536 A1 7/2008 Koch et al.
2008/0266252 A1 10/2008 Keates et al.
2009/0064514 A1 3/2009 Roes
2009/0100735 A1 4/2009 Schick et al.
2009/0139393 A1 * 6/2009 Quinn ..... 89/41.18
2009/0188976 A1 7/2009 Gunnarsson et al.
2009/0199453 A1 8/2009 Cross et al.
2009/0199702 A1 8/2009 Zaderey et al.
2009/0200376 A1 8/2009 Peters et al.
2009/0212108 A1 8/2009 Rothe et al.
2009/0213358 A1 8/2009 Vermillion et al.
2009/0218400 A1 9/2009 Boss et al.
2009/0235570 A1 9/2009 Sammut et al.
2009/0255162 A1 10/2009 Holmberg
2010/0275768 A1 * 11/2010 Quinn ..... 89/41.05
2010/0282845 A1 11/2010 Peters et al.
2011/0010981 A1 1/2011 Wieland
2011/0035980 A1 2/2011 Raviv et al.
2011/0289810 A1 * 12/2011 D'Souza et al. ..... 42/1.01
2012/0117848 A1 5/2012 Cox et al.

FOREIGN PATENT DOCUMENTS

EP 1748273 A1 1/2007
WO 9320399 A1 10/1993
WO 2006060489 A2 6/2006

OTHER PUBLICATIONS

Robert L. McCoy, Modern Exterior Ballistics (Atglen, PA; Schiffer Publishing, Ltd.; 1999), pp. 32-39, 212-215.

* cited by examiner 400
402
406
408
420
416
432
434
434
434

AIMING SYSTEM FOR WEAPON

CROSS-REFERENCE TO RELATED APPLICATIONS

This application claims the benefit of U.S. Provisional Application No. 61/360,008, filed on Jun. 30, 2010. The entire disclosure of the above application is incorporated herein by reference.

FIELD

The present disclosure relates to optical sights and more particularly to an aiming system for use with an optical sight.

BACKGROUND

This section provides background information related to the present disclosure which is not necessarily prior art.

Optical sights are conventionally used with weapons such as guns, rifles, and other firearms to allow a user to more clearly see a target. Conventional optical sights include a series of lenses that magnify an image and provide a reticle or aiming point that allows a user to align a magnified target relative to a barrel of the firearm. Proper alignment of the optical sight with the barrel of the firearm allows the user to align the barrel of the firearm and, thus, a projectile fired therefrom, with a target by properly aligning a magnified image of the target with the reticle pattern of the optical sight.

While conventional optical sights adequately magnify an image and properly align the magnified image with a barrel of a firearm, conventional optical sights do not adjust a position of a reticle relative to the optical sight based on target parameters (i.e., location, movement, etc.), environmental conditions, or otherwise. Rather, conventional optical sights are typically limited to a fixed-position reticle that a user must align relative to a target, thereby relying solely on the skill of the user in properly aligning the optical sight and firearm relative to the target.

SUMMARY

This section provides a general summary of the disclosure, and is not a comprehensive disclosure of its full scope or all of its features.

An aiming system for use with a weapon is provided and may include a processor, at least one sensor in communication with the processor, and a memory in communication with the processor. The aiming system may also include a display in communication with the processor that displays a corrected-aiming point based on at least one simulated bullet trajectory and at least one simulated bullet impact location determined by the processor.

In another configuration, an aiming system for use with a weapon is provided and may include a processor using closed-loop control to generate a corrected-aiming point by iteratively generating a simulated bullet trajectory and a simulated bullet impact location until the simulated bullet impact location impacts a desired target at a desired location.

A method is provided and may include aligning a weapon with a desired target, energizing an aiming system associated with the weapon, determining a range to the target, generating by a processor a number of simulated bullet trajectories, and generating by the processor a number of simulated bullet impact locations. The method may also include generating by the processor the simulated bullet trajectories and the simulated bullet impact locations until an error between the simulated bullet impact location and the target is within a predetermined range. A corrected-aiming point may be generated if the error is within the predetermined range to aid a shooter in adjusting a position of the weapon to allow a projectile fired from the weapon to contact the target at a desired location.

In another configuration, a method is provided and may include aligning a weapon with a static target, energizing an aiming system associated with the weapon, determining a range to the static target, and generating by a processor a static corrected-aiming point to aid a shooter in adjusting a position of the weapon to allow a projectile fired from the weapon to contact the static target at a desired location. The method may also include detecting movement of the target and generating by the processor a moving corrected-aiming point based on the static corrected-aiming point to aid the shooter in adjusting a position of the weapon to allow a projective fired from the weapon to contact the moving target at a desired location.

In another configuration, an aiming system for use with a weapon is provided and may include a housing, an optics train disposed within the housing and including an optical element having a reticle, and a laser-range finder supported by the housing adjacent to the optics train. The aiming system may also include a linkage attached to the laser-range finder and supported by the housing by a grommet that permits rotation of the linkage relative to the housing and permits pivoting of the linkage relative to the housing. The linkage may adjust a position of the laser-range finder in a first direction in response to movement of the optical element in the first direction by rotating about the grommet and may adjust a position of the laser-range finder in a second direction in response to movement of the optical element in the second direction by pivoting at the grommet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
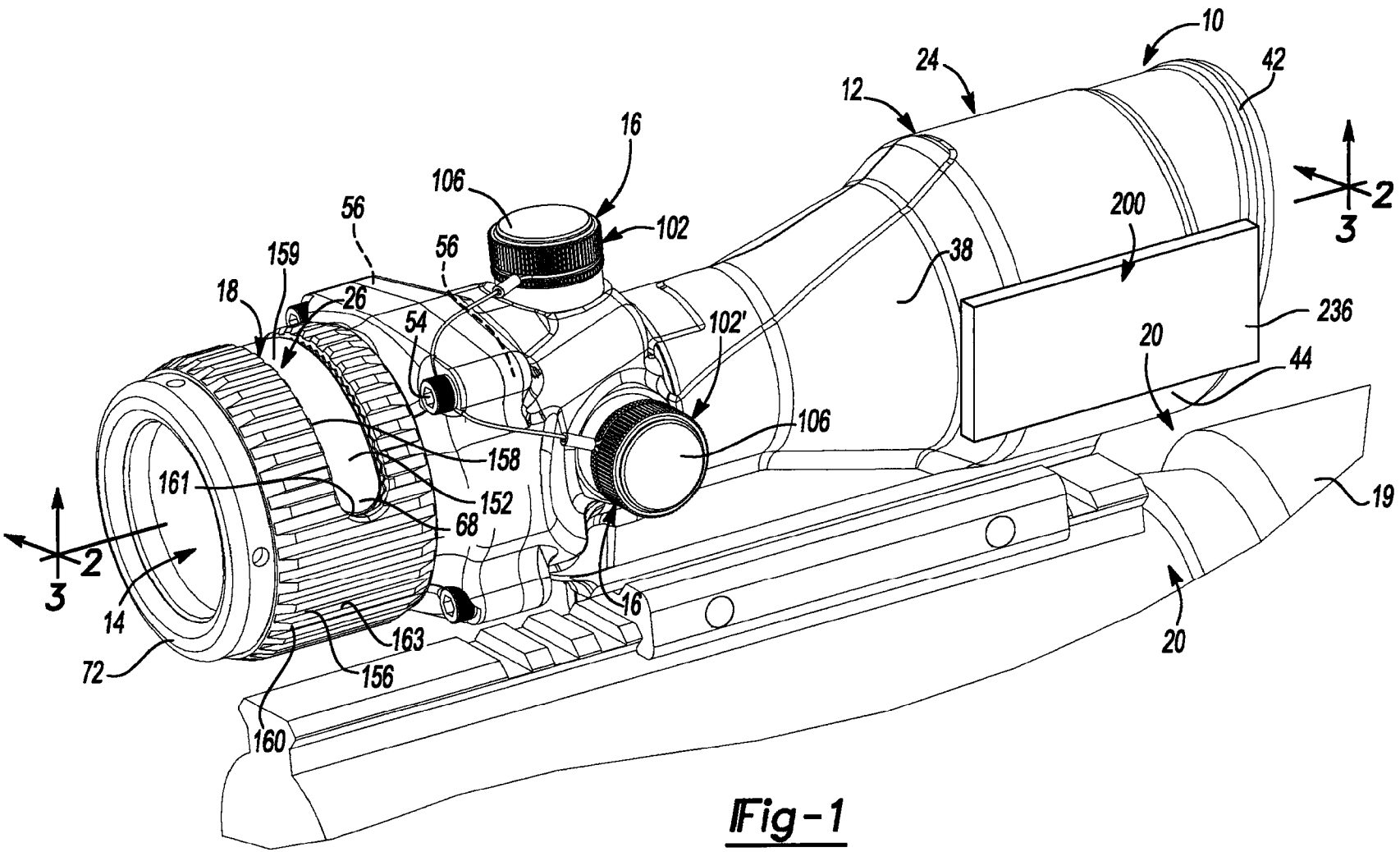
FIG. 1 is a partial perspective view of a firearm incorporating an optical sight and aiming system in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, an optical sight 10 is provided and includes a housing 12, an optics train 14, an adjustment system 16, and an illumination system 18. The housing 12 may be selectively attached to a firearm 20 and supports the optics train 14, adjustment system 16, and illumination system 18. The optics train 14 cooperates with the housing 12 to provide a magnified image of a target while the adjustment system 16 positions the optics train 14 relative to the housing 12 to properly align the optics train 14 relative to the firearm 20. In one configuration, the optics train 14 magnifies a target to a size substantially equal to six times the viewed size of the target (i.e., 6× magnification). The illumination system 18 cooperates with the optics train 14 to illuminate a reticle pattern 22 (FIGS. 7 and 8) to assist in aligning the target relative to the optical sight 10 and firearm 20.

The housing 12 includes a main body 24 attached to an eyepiece 26. The main body 24 includes a series of threaded bores 28 for use in attaching the housing 12 to the firearm 20 and an inner cavity 30 having a longitudinal axis 32. A first end 34 of the main body 24 includes a substantially circular shape and is in communication with the inner cavity 30 of the housing 12. A second end 36 is disposed generally on an opposite side of the main body 24 from the first end 34 and similarly includes a generally circular cross section. A tapered bore portion 38 is disposed between the first end 34 and second end 36 and includes a stepped surface 40 that defines a profile of the tapered bore portion 38.

The first end 34 of the main body 24 includes an entrance pupil having a larger diameter than an exit pupil of the second end 36. The entrance pupil of the first end 34 defines how much light enters the optical sight 10 and cooperates with the exit pupil to provide the optical sight 10 with a desired magnification. In one configuration, the entrance pupil includes a diameter that is substantially six times larger than a diameter of the exit pupil. Such a configuration provides the optical sight 10 with a "6× magnification." While the exit pupil is described as being six times smaller than the entrance pupil, the exit pupil may be increased to facilitate alignment of a user's eye with the optical sight 10. The first end 34 may include a truncated portion 42 that extends toward a target a greater distance than a bottom portion 44 to prevent ambient light from causing a glare on the optics train 14.

The main body 24 supports the adjustment system 16 and may include at least one bore 46 that operably receives a portion of the adjustment system 16 therein. The main body 24 may also include an inner arcuate surface 48 that cooperates with the adjustment system 16 to adjust a position of the reticle pattern 22 relative to a target.

The main body 24 may include a locking feature 50 that cooperates with the eyepiece 26 to position the main body 24 relative to the eyepiece 26 and attaches the main body 24 to the eyepiece 26. The locking feature 50 may include a tab 52 extending from the main body 24 for interaction with the eyepiece 26. An annular seal 53 may be disposed between the main body 24 and the eyepiece 26 for providing a seal between mating flange surfaces. For example, the annular seal 53 may be disposed in the locking feature 50 for providing such a seal. While the main body 24 is described as including locking feature 50 having tab 52 and annular seal 53, the main body 24 could additionally and/or alternatively include any locking feature that attaches the main body 24 to the eyepiece 26. For example, the locking feature 50 could include a series of fasteners 54 (FIG. 1) that are received through the eyepiece 26 and inserted into the main body 24 to position the eyepiece 26 relative to the main body 24 and to attach the eyepiece 26 to the main body 24. If fasteners 54 are used to attach the eyepiece 26 to the main body 24, the main body 24 may include a series of threaded bores 56 that matingly receive the fasteners 54.

The eyepiece 26 is matingly received by the main body 24 and may be attached thereto via the locking feature 50, as described above. As such, the eyepiece 26 may similarly include threaded bores 58 (not shown) that matingly receive the fasteners 54.

The eyepiece 26 includes a longitudinal axis 60 that is co-axially aligned with the longitudinal axis 32 of the main body 24 when the eyepiece 26 is assembled to the main body 24. The eyepiece 26 includes a first end 62 attached to the main body 24 via the locking feature 50 and a second end 64 disposed on an opposite end of the eyepiece 26 from the first end 62. The first end 62 may include an inner arcuate surface 66 that is aligned with the inner arcuate surface 48 of the main body 24 when the eyepiece 26 is attached to the main body 24. The inner arcuate surface 66 cooperates with the inner arcuate surface 48 of the main body 24 to create a spherical seat, which permits movement of a portion of the optics train 14 relative to the housing 12 during adjustment of the optics train 14. As will be described further below, movement of a portion of the optics train 14 relative to the housing 12 provides for adjustment for the reticle pattern 22 relative to the housing 12 and, thus, alignment of the optical sight 10 relative to the firearm 20. A retainer ring 72 may be positioned at a distal end of the eyepiece 26, adjacent to the illumination system 18, and may be used to retain an adjustment mechanism such as, for example, a rotary dial of the illumination system 18. The first end 62 may also include a recess 68 that receives at least a portion of the illumination system 18.

Figure 2:
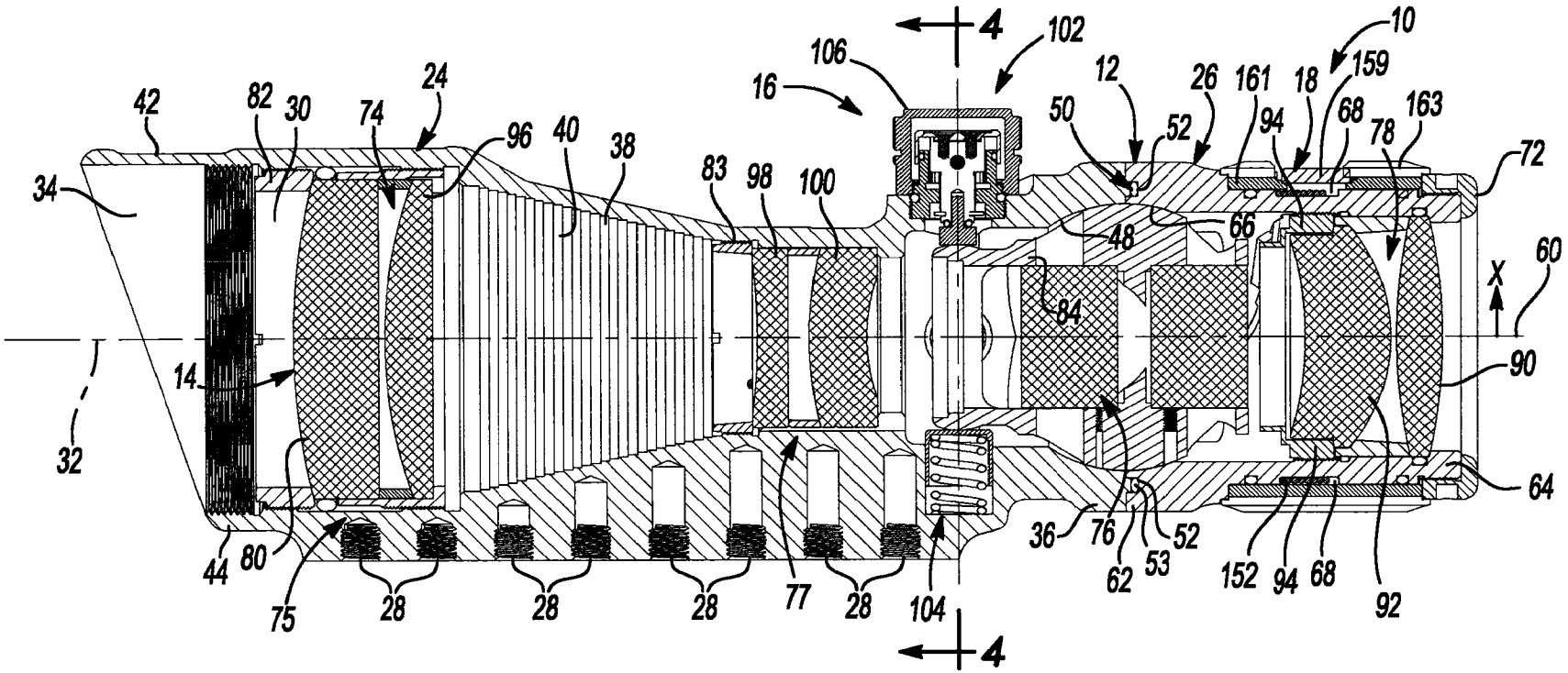
FIG. 2 is a cross-sectional view of the optical sight of FIG. 1 taken along line 2-2 of FIG. 1.
Figure 3:
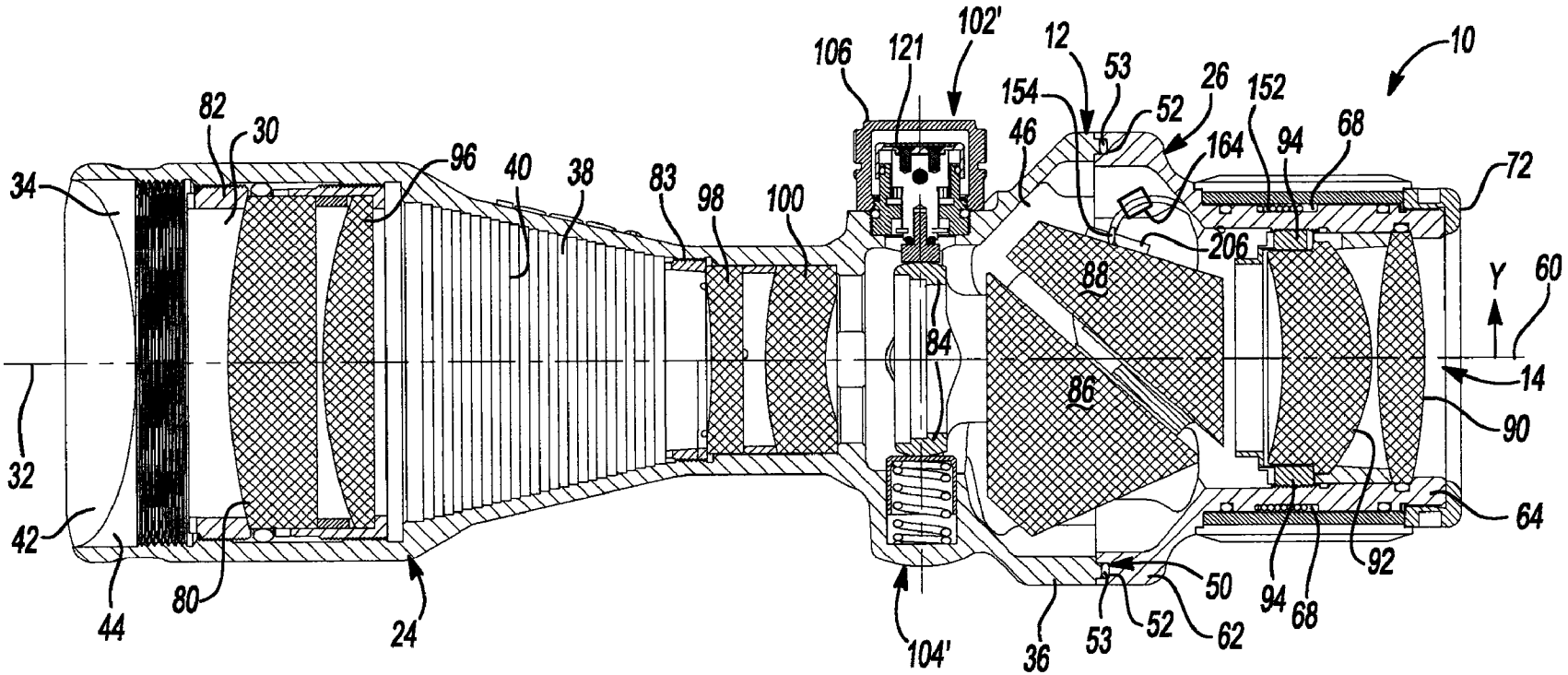
FIG. 3 is a cross-sectional view of the optical sight of FIG. 1 taken along line 3-3.

With particular reference to FIGS. 2 and 3, the optics train 14 is shown to include an objective lens system 74, an image erector system 76, and an ocular lens system 78. The objective lens system 74 is a telephoto objective and includes a front positive power group 75 and a rear negative power group 77. The front positive power group 75 is disposed generally proximate to the first end 34 of the main body 24 and includes a convex-plano doublet lens 80 having a substantially doublet-convex lens and a substantially concave-convex lens secured together by a suitable adhesive and a convex-plano singlet lens 96. The lenses 80, 96 may be secured within the first end 34 of the main body 24 via a threaded retainer ring 82 and/or adhesive to position and attach the lenses 80, 96 relative to the main body 24 of the housing 12.

The rear negative power group 77 is disposed generally between the front positive power group 75 and the second end 36 of the main body 24 and includes a concave-plano singlet lens 98 and a convex-concave doublet lens 100. As with the front positive power group 75, the singlet lens 98 and doublet lens 100 of the rear negative power group 77 may be retained and positioned within the main body 24 of the housing 12 via a threaded retainer 83 and/or an adhesive.

The image erector system 76 is disposed within the housing 12 generally between the objective lens system 74 and the ocular lens system 78. The image erector system 76 includes a housing 84, a roof prism 86, and a mirror prism 88, which cooperate to form a Pechan prism assembly. The image erector system 76 cooperates with the objective lens system 74 and ocular lens system 78 to properly orient an image of a sighted target relative to the housing 12, and thus, the firearm 20. For example, when an image is received at the first end 34 of the main body 24, the image travels along the longitudinal axis 32 of the main body 24 and travels along a light path of the Pechan prism assembly prior to being viewed at the eyepiece 26. The image erector system 76 also cooperates with the illumination system 18 to provide the overall shape and size of the reticle pattern 22 displayed at an eyepiece lens 90.

The image from the image erector system 76 is received by the ocular lens system 78 disposed proximate to the eyepiece 26. The ocular lens system 78 is disposed generally on an opposite end of the optical sight 10 from the objective lens system 74 and includes the eyepiece lens 90, which may be of a bi-convex singlet or substantially doublet-convex type lens, and a doublet ocular lens 92. Hereinafter, the eyepiece lens 90 will be described as doublet-convex eyepiece lens 90. The doublet ocular lens 92 may include a substantially doublet-convex lens and a substantially doublet-concave lens secured together by a suitable adhesive. The doublet-convex eyepiece lens 90 and doublet ocular lens 92 may be held in a desired position relative to the eyepiece 26 of the housing 12 via a threaded retainer ring 94. While threaded retainer ring 94 is disclosed, the doublet-convex eyepiece lens 90 and doublet ocular lens 92 could alternatively and/or additionally be attached to the eyepiece 26 of the housing 12 using an adhesive.

The optical sight 10 provides a magnification of a target of approximately six times (i.e., 6× magnification) the size of the viewed target (i.e., the target as viewed without using the optical sight 10). Increasing the ability of the optical sight 10 to magnify an image of a target improves the ability of the optical sight 10 in enlarging distant targets and allows the optical sight 10 to enlarge targets at greater distances. Generally speaking, such improvements in magnification can be achieved by introducing an objective lens having a longer focal length. However, increasing the length of the objective lens focal length increases the overall length of the housing 12 and therefore also increases the overall length and size of the optical sight 10.

As described above, a 6× magnification is achieved in the present disclosure by increasing the objective lens focal length through use of multiple lenses. Cooperation between the convex-plano singlet lens 96, concave-plano singlet lens 98, and doublet lens 100 with the objective lens system 74, image erector system 76, and ocular lens system 78 provides the optical sight 10 with the ability to magnify a target six times greater than the viewed size of the target. Specifically, adding lenses 96, 98, and 100 to the front positive power group 75 and a rear negative power group 77, respectively, allows the optical sight 10 to have a 6× magnification without requiring a lengthy and cumbersome housing.

Figure 4A:
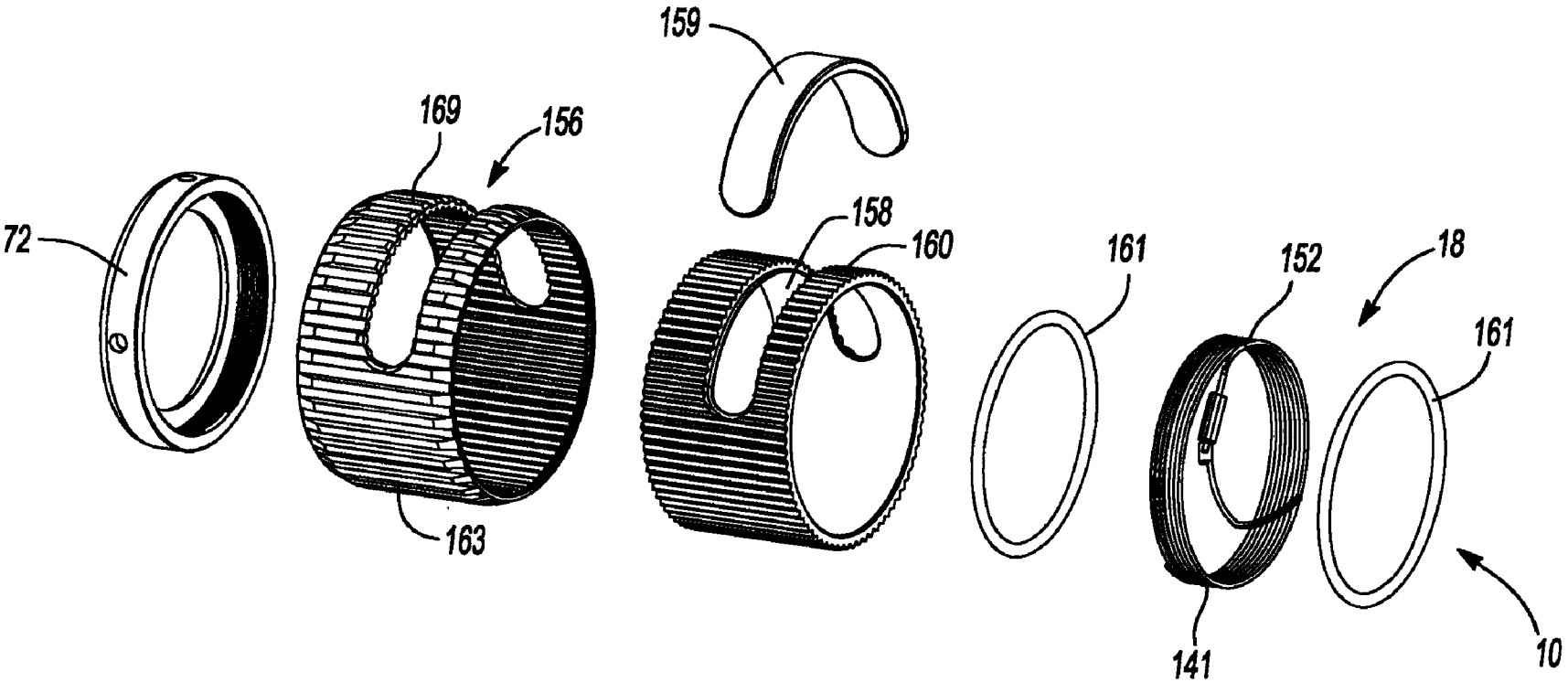
FIG. 4A is an exploded view of an illumination system for use with the optical sight of FIG. 1.
Figure 4B:
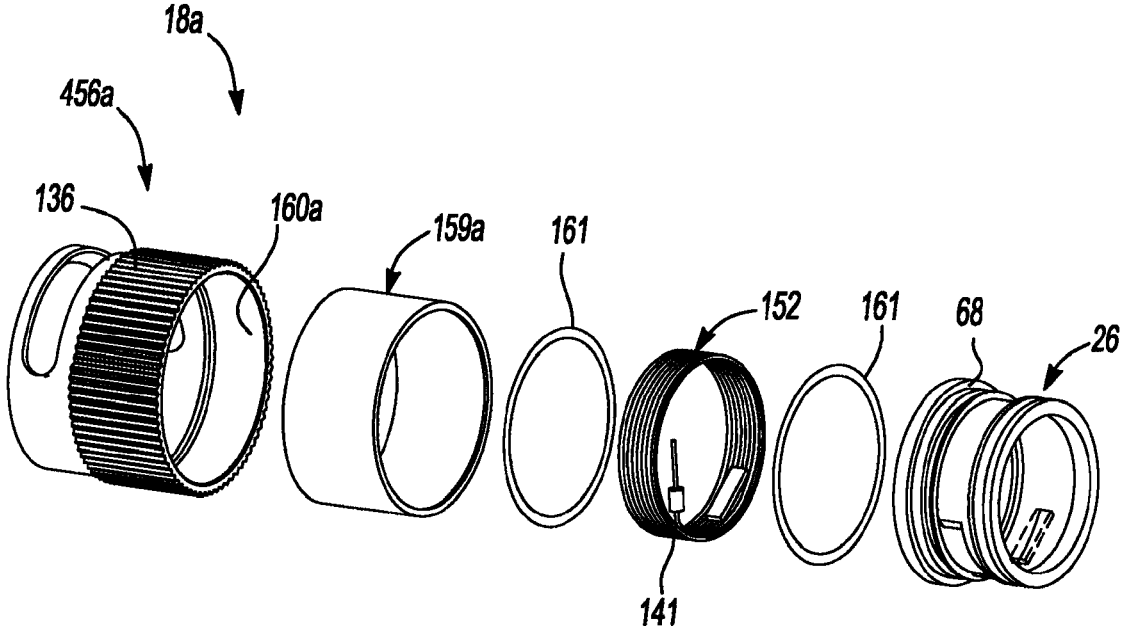
FIG. 4B is an exploded view of an illumination system for use with an optical sight.
Figure 5A:
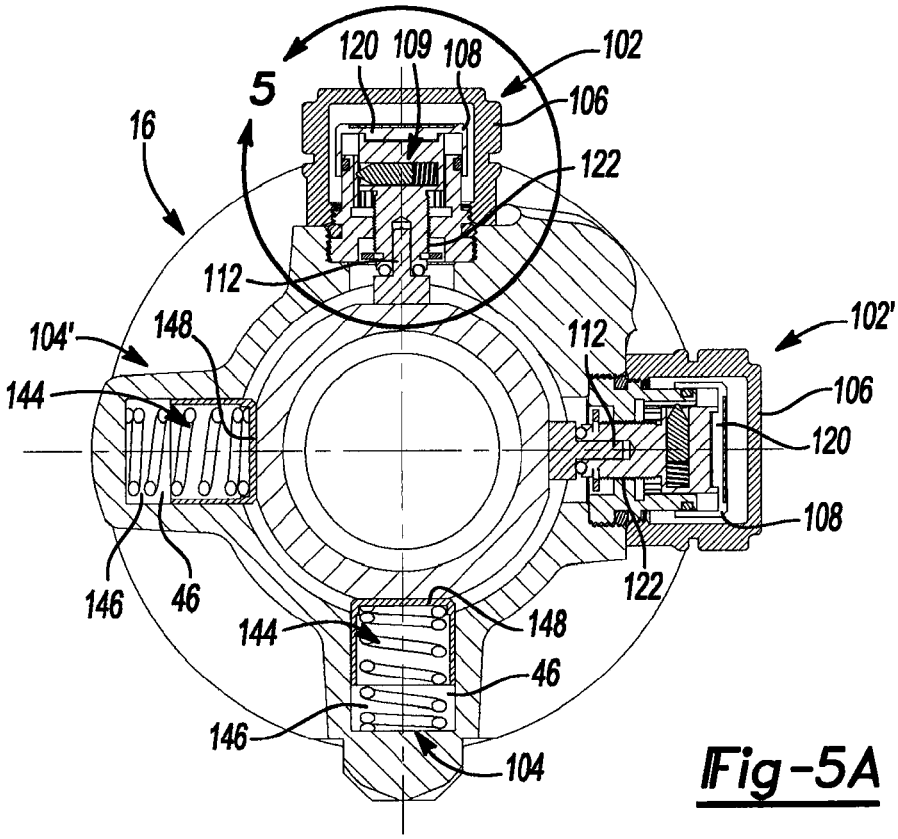
FIG. 5A is a cross-sectional view of an adjustment assembly of the optical sight of FIG. 1.
Figure 5B:
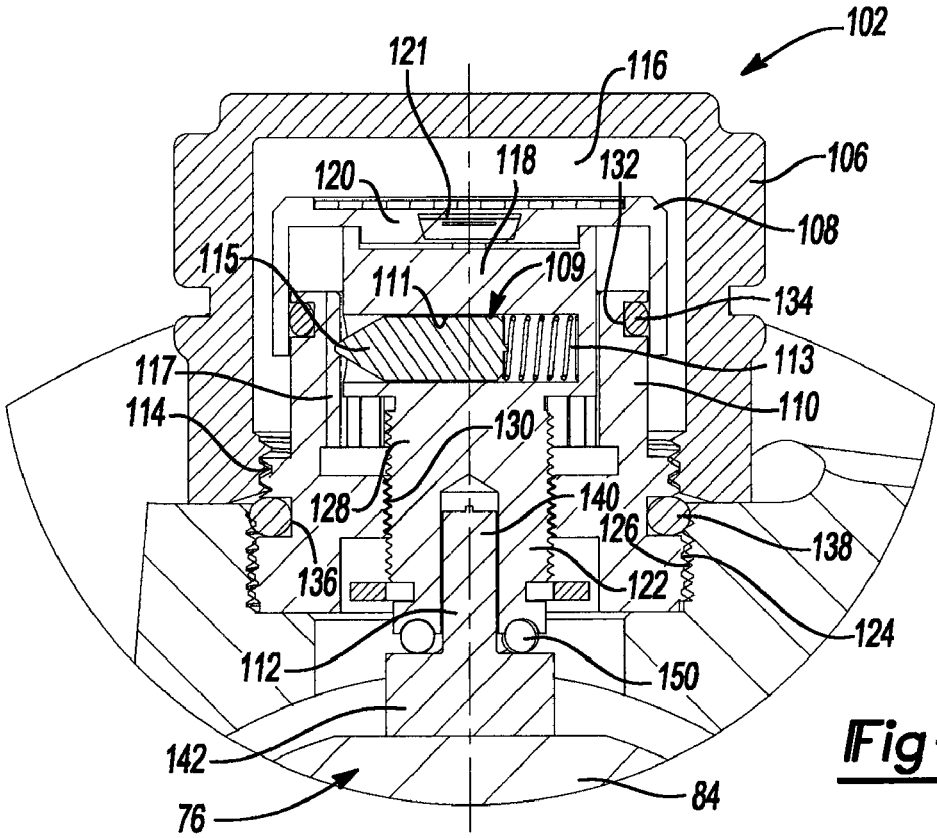
FIG. 5B is a partial cross-sectional view of an adjuster of the adjustment assembly of FIG. 5A.

With particular reference to FIGS. 4 and 5, the adjustment system 16 is shown to include adjustment assemblies 102, 102' and biasing assemblies 104, 104'. The adjustment assemblies 102, 102' cooperate with the biasing assemblies 104, 104' to selectively move the housing 84 of the image erector system 76 relative to the housing 12. Movement of the housing 84 of the image erector system 76 relative to the housing 12 similarly moves the roof prism 86 and mirror prism 88 relative to the housing 12 and therefore may adjust a position of the reticle pattern 22 relative to the housing 12. Such adjustments of the reticle pattern 22 relative to the housing 12 may be used to align the reticle 22 relative to the firearm 20 to account for windage and elevation.

As shown in FIGS. 2 and 5, the optical sight 10 of the present teachings includes first adjuster assembly 102 and first biasing assembly 104 that cooperate to rotate the housing 84 of the image erector system 76 relative to the housing 12 to adjust an elevation of the reticle pattern 22. Rotation of the housing 84 causes the reticle pattern 22 to move in a direction substantially perpendicular to axes 32, 60, as schematically represented by arrow "X" in FIG. 2.

As shown in FIGS. 3 and 5, the optical sight 10 of the present teachings includes second adjuster assembly 102' and second biasing assembly 104' that also cooperate with each other to move the housing 84 of the image erector system 76 relative to the housing 12. Movement of the housing 84 of the image erector system 76 relative to the housing 12 similarly moves the reticle pattern 22 relative to the housing 12. Such movement of the reticle pattern 22 relative to the housing 12 may be performed to adjust for windage to properly align the reticle pattern 22 relative to the housing 12 and, thus, the optical sight 10 with the firearm 20. Such movement of the reticle pattern 22 is substantially perpendicular to axes 32, 60 and to arrow X, as schematically represented by arrow "Y" in FIG. 3.

Because the first adjuster assembly 102 is substantially identical to the second adjuster assembly 102' and the first biasing assembly 104 is substantially identical to the second biasing assembly 104', a detailed description of the second adjuster assembly 102' and second biasing assembly 104' is foregone.

With reference to FIGS. 4 and 5, the first adjuster assembly 102 is shown to include a cap 106, an adjustment knob 108, a detent assembly 109, a hollow adaptor 110, and an engaging pin 112. The cap 106 is selectively attachable to the housing 12 and may include a series of threads 114 for mating engagement with the hollow adaptor 110. The cap 106 includes an inner volume 116 that generally receives the adjustment knob 108 and a portion of the hollow adaptor 110. While the cap 106 is shown and described as including the series of threads 114 that selectively attach the cap 106 to the housing 12, the cap 106 could include any feature that allows for selective attachment of the cap 106 to the housing 12 such as, for example, a snap fit and/or mechanical fastener.

The adjustment knob 108 is disposed generally within the inner volume 116 of the cap 106 and includes a plug 118 rotatably attached to the hollow adaptor 110 and a top cap 120 attached to the plug 118 via a series of fasteners 121 and/or adhesive. The plug 118 includes a threaded extension 122 that is matingly received with the hollow adaptor 110 such that rotation of the plug 118 and top cap 120 relative to the hollow adaptor 110 causes the plug 118 and top cap 120 to move towards or away from the housing 12, depending on the direction of rotation of the plug 118 relative to the hollow adaptor 110.

The detent assembly 109 may be located in a radial cross bore 111 formed through the plug 118 and may include a spring 113 that imparts a biasing force on a detent pin 115. The bias imparted on the detent pin 115 by the spring 113 urges the detent pin 115 outwardly from the cross bore 111 and into engagement with a side wall of the hollow adaptor 110. A plurality of axially extending grooves 117 may be circumferentially located at spaced-apart intervals around an inner surface of the hollow adaptor 110 such that upon threadably advancing or retracting the plug 118, discernible physical and/or audible 'clicks' can be sensed by the operator, as the detent pin 115 moves into an adjacent groove 117 to facilitate calibration of the optical sight 10.

The hollow adaptor 110 is attached to the housing 12 and may include a series of external threads 124 that are matingly received within a threaded bore 126 of the housing 12. While the hollow adaptor 110 is described and shown as being attached to the housing 12 via a threaded connection, the hollow adaptor 110 could be attached to the housing 12 via any suitable means such as, for example, an epoxy and/or press fit.

The hollow adaptor 110 includes a central bore 128 having a series of threads 130 that matingly receive the threaded extension 122 of the plug 118. As described above, when a force is applied to the adjustment knob 108 such that the plug 118 and threaded extension 122 rotate relative to the hollow adaptor 110, the plug 118 and threaded extension 122 move towards or away from the housing 12 due to engagement between the threaded extension 122 of the plug 118 and the threads 130 of the hollow adaptor 110. The hollow adaptor 110 may also include at least one recess 132 formed on an outer surface thereof for receiving a seal 134 to seal a connection between the hollow adaptor 110 and the housing 12. A similar recess 136 may be formed in the hollow adaptor 110 proximate to the top cap 120 of the adjustment knob 108 and may similarly receive a seal 138 to seal a connection between the hollow adaptor 110 and the top cap 120 of the adjustment knob 108. The recesses 132, 136 may be formed integrally with the hollow adaptor 110 and/or may be machined in an outer surface of the hollow adaptor 110. The seals 134, 138 may be any suitable seal such as, for example, an O-ring.

Engaging pin 112 is received generally within the threaded extension 122 of the plug 118 and includes an attachment portion 140 rotatably received within the threaded extension 122 of the plug 118 and an engagement portion 142 extending from a distal end of the attachment portion 140. The threaded extension 122 is fixed for movement with the plug 118.

The engagement portion 142 extends from the attachment portion 140 and is in contact with the housing 84 of the image erector system 76. The first biasing assembly 104 biases the housing 84 of the image erector system 76 into engagement with the engagement portion 142 of the engaging pin 112. The first biasing assembly 104 includes a biasing member 144 disposed within a bore 146 of the housing 12. The biasing member 144 may be in contact with the housing 84 of the image erector system 76 or, alternatively, a cap 148 may be disposed generally between the biasing member 144 and the housing 84 of the image erector system 76. In either configuration, the biasing member 144 applies a force to the housing 84 of the image erector system 76, urging the housing 84 into engagement with the engagement portion 142 of the engaging pin 112. The biasing member 144 may be any suitable spring such as, for example, a coil spring or a linear spring.

Because the housing 84 of the image erector system 76 is biased into engagement with the engagement portion 142 of the engaging pin 112, movement of the engaging pin 112 relative to the hollow adaptor 110 causes movement of the housing 84 of the image erector system 76 relative to the housing 12. Positioning ball bearings 150 generally between the engagement portion 142 and a bottom portion of the hollow adaptor 110 may dampen such movement of the engaging pin 112 relative to the hollow adaptor 110. The ball bearings 150 may provide a seal between the engagement portion 142 and the hollow adaptor 110 and may also dampen movement of the engaging pin 112 when the engaging pin 112 is moved toward and away from the housing 12 to ensure quiet operation of the adjustment system 16.

With continued reference to FIGS. 4 and 5, operation of the adjustment system 16 will be described in detail. To adjust the elevation of the reticle pattern 22 relative to the housing 12, the cap 106 is removed from engagement with the housing 12. In one configuration, the cap 106 is threadably attached to the housing 12. Therefore, to remove the cap 106 from engagement with the housing 12, a force is applied to the cap 106 to rotate the cap 106 relative to the housing 12. Once the cap 106 has been rotated sufficiently relative to the housing 12, the cap 106 may be removed from engagement with the housing 12.

Removal of the cap 106 from engagement with the housing 12 exposes the top cap 120 of the adjustment knob 108. Exposing the adjustment top cap 120 allows a force to be applied to the plug 118 of the adjustment knob 108 via the top cap 120. A rotational force may be applied generally to the top cap 120 of the adjustment plug 118 to rotate the plug 118 and threaded extension 122 relative to the hollow adaptor 110. Rotation of the plug 118 and threaded extension 122 relative to the hollow adaptor 110 causes the threaded extension 122 to move relative to the central bore 128 of the hollow adaptor 110.

As described above, the central bore 128 may include threads 130 that engage the threaded extension 122. Therefore, as the plug 118 and threaded extension 122 are rotated relative to the housing, the plug 118, top cap 120 and threaded extension 122 are caused to move towards or away from the hollow adaptor 110 due to engagement between the threads 130 of the central bore 128 and the threaded extension 122, depending on the direction of rotation of the threaded extension 122. The engaging pin 112 is attached to the threaded extension 122 of the adjustment knob 108 and therefore moves with the plug 118, top cap 120, and threaded extension 122 when the plug 118, top cap 120, and threaded extension 122 move relative to the hollow adaptor 110.

When the force applied to the top cap 120 causes the threaded extension 122 to move towards the hollow adaptor 110, the engaging pin 112 applies a force in a "Z" direction (FIG. 5B) to the housing 84 of the image erector system 76. Application of a force in the Z direction to the housing 84 of the image erector system 76 causes the housing 84 to move against the bias imparted on the housing 84 by the first biasing assembly 104. Such movement of the housing 84 causes concurrent movement of the reticle pattern 22 in the Z direction relative to the housing 12 and therefore adjusts the elevation of the reticle pattern 22 relative to the housing 12.

When a force is applied to the top cap 120 in an opposite direction, the threaded extension 122 and engaging pin 112 move away from the hollow adaptor 110 in the Z direction. The housing 84 of the image erector system 76 similarly moves in a direction opposite to the Z direction due to the force imparted on the housing 84 by the biasing member 144 of the first biasing assembly 104. As noted above, regardless of movement of the threaded extension 122 and engaging pin 112 in a direction generally opposite to the Z direction, the housing 84 of the image erector system 76 is maintained in contact with the engagement portion 142 of the threaded extension 122 due to the force imparted on the housing 84 of the image erector system 76 by the biasing member 144 of the first biasing assembly 104.

Once the elevation of the reticle pattern 22 is adjusted relative to the housing 12, the cap 106 may be positioned over the adjustment knob 108 and hollow adaptor 110 and may be reattached to the housing 12. Attachment of the cap 106 to the housing 12 prevents further manipulation of the adjustment knob 108 and therefore aids in preventing further adjustment of the elevation of the reticle pattern 22 until the cap 106 is once again removed from the housing 12. In other words, the cap 106 prevents inadvertent forces from being applied to the top cap 120 causing the plug 118 and threaded extension 122 from rotating relative to the hollow adaptor 110 when an elevational adjustment is not desired. A similar approach may be performed on the second adjuster assembly 102' and second biasing assembly 104' to adjust the windage by moving the reticle pattern 22 relative to the housing 12 in a direction substantially perpendicular to the Z direction.

With particular reference to FIGS. 1-4B, the illumination system 18 is shown to include a fluorescent fiber 152 attached to the eyepiece 26 of the housing 12. The fluorescent fiber 152 is shown as being wound around an exterior surface of the eyepiece 26 and is generally received within the recess 68 of the eyepiece 26. The fluorescent fiber 152 may capture ambient light, illuminate the ambient light at a predetermined color (red or yellow, for example), and direct the ambient light along a length of the fluorescent fiber 152.

The fluorescent fiber 152 may axially surround the eyepiece 26 of the housing 12 such that the fiber 152 surrounds an entire perimeter of the eyepiece 26 (i.e., is wrapped 360 degrees around an outer surface of the eyepiece 26). The fluorescent fiber 152 may include an end disposed within the eyepiece 26 that is directed generally towards the image erector system 76 to illuminate the reticle pattern 22. For example, the fluorescent fiber 152 may include an end 154 (FIG. 3) that extends from the recess 68 of the eyepiece 26 that is attached to the mirror prism 88 to illuminate the reticle portion 22. In operation, the fluorescent fiber 152 receives ambient light and directs the ambient light along a length of the fluorescent fiber 152 and generally towards end 154. Upon reaching end 154 of the fluorescent fiber 152, the light is supplied to the mirror prism 88 to illuminate the reticle pattern 22. The reticle pattern 22 may be etched in a face of the mirror prism 88 such that light from the fluorescent fiber 152 illuminates only the etched portion of the mirror prism 88. In other words, light from the fluorescent fiber 152 is only transmitted through the mirror prism 88 at a portion of the mirror prism 88 that is etched and therefore only the transmitted portion is viewed at the eyepiece lens 90. The reticle pattern 22 is therefore defined by the overall shape and size of the etched portion of the mirror prism 88. Because the fluorescent fiber 152 collects and directs ambient light along a length of the fluorescent fiber 152 towards end 154, the fluorescent fiber 152 may be considered a conduit that traps ambient light and directs the ambient light along a length of the fluorescent fiber 152.

Wrapping the fluorescent fiber 152 completely around the exterior surface of the eyepiece 26 increases the overall surface area of exposed fiber 152, which maximizes the amount of light that may be received by the fiber 152. Furthermore, wrapping the fluorescent fiber 152 completely around the eyepiece 26 reduces the overall length of the optical sight 10, as width of the wound fiber 152 is reduced while still maintaining a sufficient area of exposed fiber 152 to collect light.

While wrapping the fluorescent fiber 152 completely around the eyepiece 26 increases the surface area of exposed fiber 152, a portion of the wound fiber 152 may include a coating 141 (FIG. 4A) to restrict light from being collected by the fiber 152. For example, a coating, such as a black mask, may be applied to a portion of the wound fiber 152 on a bottom portion of the optical sight 10. The coating prevents light from being collected by the fiber 152 where the mask is applied to limit light collection to a region generally between ends of the coating.

Illumination of the reticle pattern 22 allows use of the optical sight 10 in various environmental conditions. Illumination of the reticle pattern 22 may be adjusted depending on such environmental conditions. For example, in dark conditions, the reticle pattern 22 may be illuminated to allow use of the optical sight 10 at night time and/or under dark conditions such as, for example, in a building. In other conditions, the reticle pattern 22 may be illuminated to allow the reticle pattern 22 to stand out in a bright place, such as when using the optical sight 10 in sunlight and/or amongst other illuminated devices (i.e., traffic or brake lights in a military combat zone, for example).

Illumination of the reticle pattern 22 is dictated generally by the conditions in which the optical sight 10 is used. For example, when using the optical sight 10 at night, the reticle pattern 22 may only be illuminated sufficiently such that a user may see the reticle pattern 22 but not to such an extent that the reticle pattern 22 is visible at the first end 34 of the housing 12. In contrast, when using the optical sight 10 in sunny conditions and amongst other lights, such as, for example traffic lights in a military combat zone, the reticle pattern 22 may be illuminated to a greater extent to allow the reticle pattern 22 to stand out from the bright lights and allow the user to clearly see the reticle pattern 22.

Adjustment of the amount of light supplied to the reticle pattern 22 may be incorporated in the illumination system 18 through a rotary dial or sleeve 156 movably supported by the eyepiece 26 of the housing 12. While the dial/sleeve 156 will hereinafter be described and shown in the drawings as being rotatable relative to the housing 12, the dial/sleeve 156 could alternatively be slidable or otherwise movable relative to the housing 12 to selectively expose the fluorescent fiber 152.

The rotary dial 156 may include a body 160 having an opening 158 formed therethrough that selectively allows ambient light through the rotary dial 156. The body 160 may be formed from a rigid material such as, for example, metal, and may be rotatably supported relative to the housing 12 by the eyepiece 26. The opening 158 may include a cover 159 that is attached to the rotary dial 156 and rotates with the rotary dial 156. The cover 159 may be formed from a transparent or translucent material such as, for example, clear plastic. While the cover 159 is described as being formed from a clear plastic material, the cover 159 may be formed from any material that permits light to pass therethrough and be collected by the fluorescent fiber 152.

Allowing the cover 159 to rotate with the rotary dial 156 seals the recess 68 and prevents intrusion of dust and other debris into the recess 68. Preventing dust and other debris from entering the recess 68 likewise prevents such contaminants from encountering the fluorescent fiber 152, which prevents damage to the fiber 152 and maintains an outer surface of the fiber 152 clean. Furthermore, by attaching the cover 159 to the rotary dial 156, the cover 159 rotates with the dial 156 and is spaced apart from the fiber 152. As such, any dust and/or other debris disposed between the cover 159 and the fiber 152 does not damage an outer surface of the fiber 152 when the rotary dial 156 is moved relative to the fiber 152. Furthermore, because the cover 159 rotates with the rotary dial 156, dust and/or other debris is not allowed to collect between an outer surface of the cover 159 and the rotary dial 156, thereby preventing damage to the outer surface of the cover 159 caused by movement of the rotary dial 156 relative to the cover 159.

A pair of O-ring seals 161 may be provided generally between the body 160 and an outer surface of the eyepiece 26 to prevent the intrusion of dust and other debris between the cover 159 and the recess 68 and to space the body 160 away from the fiber 152. The O-ring seals 161 may provide the recess 68 with an air-tight seal that prevents intrusion of fluid such as, for example, air, nitrogen, and/or water or other debris such as dust and/or dirt into the recess 68. For example, in one configuration, the O-ring seals 161 provide a hermetic seal between the body 160 and the eyepiece 26. The O-ring seals 161 may be formed from an elastomeric material such as, for example, rubber.

An elastomeric material 169, such as, for example, rubber, may be disposed generally around an outer surface of the body 160. The elastomeric material 169 may include a series of projections 163 that facilitate gripping and turning of the body 160 and, thus, the rotary dial 156. The elastomeric material 169 may be positioned such that the elastomeric material 169 completely surrounds the cover 159 and further seals an interface between the body 160 and the cover 159 to prevent intrusion of fluid and/or other debris from entering the recess 68 and interfering with operation of the fluorescent fiber 152.

With particular reference to FIG. 4B, another illumination system **18*a* is provided for use with the optical sight 10. In view of the substantial similarity in structure and function of the components associated with the illumination system 18 with respect to the illumination system 18*a***, like reference numerals are used hereinafter and in the drawings to identify like components while like reference numerals containing letter extensions are used to identify those components that have been modified.

The illumination system 18*a* may include a body 160*a* rotatably supported by the eyepiece 26 of the housing 12. The body 160*a* may include an opening 158 formed therethrough and an elastomeric material 169*a* formed over an outer surface of the body 160*a*. A cover 159*a* may be received generally within the body 160*a* and may be formed from a transparent or translucent material such as, for example, clear plastic. While the cover 159*a* is described as being formed from a clear plastic material, the cover 159*a* may be formed from any material that permits light to pass therethrough and be collected by the fluorescent fiber 152.

A pair of O-ring seals 161 may be disposed generally between the eyepiece 26 and the body 160*a* to prevent intrusion of fluid such as, for example, air and/or water or other debris such as dirt and/or dust into the recess 68. The O-ring seals 161 may be positioned between an inner surface of the cover 159*a* and an outer surface of the eyepiece 26 or, alternatively, may be positioned between an inner surface of the body 160*a* and the outer surface of the eyepiece 26. In either configuration, the O-ring seals 161 provide an air-tight seal between the cover 159*a* and the recess 68 to prevent intrusion of fluid and/or debris into the recess 68. Furthermore, the O-ring seals 161 space the cover 159*a* away from the fiber 152 to prevent contact between the cover 159*a* and the fiber 152.

In either of the above configurations, the width of the opening 158 may be equivalent to or slightly smaller than a width of the coating 141 applied to the fluorescent fiber 152 to allow the rotary dial 156 to substantially prevent or limit light from being collected by the fluorescent fiber 152. For example, if the rotary dial 156 is rotated such that the cover 159 opposes the coating 141, the coating 141 could extend over the fiber 152 a sufficient distance such that the exposed fiber 152 under the cover 159 is completely coated and therefore cannot collect light. The above feature allows a user to substantially completely prevent light collection by the fluorescent fiber 152 by positioning the cover 159 over the coated fiber 152.

As shown in FIG. 1, the rotary dial 156 is rotatably attached to the eyepiece 26 such that the body 160 of the rotary dial 156 selectively covers the recess 68 of the eyepiece 26. Rotation of the rotary dial 156 relative to the eyepiece 26 causes similar rotation of the opening 158 relative to the eyepiece 26. When the rotary dial 156 is positioned such that the body 160 generally covers the recess 68, the body 160 of the rotary dial 156 covers the fluorescent fiber 152 disposed generally within the recess 68. In this position, ambient light is restricted from entering the recess 68 and is therefore restricted from being trapped by the fluorescent fiber 152. In this position, the fluorescent fiber 152 supplies only a limited amount of light to the reticle pattern 22. The limited amount of light supplied to the reticle pattern 22 limits the intensity of illumination of the reticle pattern 22.

To once again permit ambient light into the recess 68, the rotary dial 156 may be rotated relative to the eyepiece 26 until the opening 158 exposes the recess 68 and fluorescent fiber 152. At this position, the opening 158 allows ambient light to travel through the rotary dial 156 and into the fluorescent fiber 152. By allowing ambient light into the recess 68 and, thus, into the fluorescent fiber 152, the rotary dial 156 allows the fluorescent fiber 152 to deliver ambient light to the reticle pattern 22 to illuminate the reticle pattern 22. As noted above, different conditions require different amounts of ambient light to be supplied to the reticle pattern 22. The rotary dial 156 and opening 158 cooperate to allow for infinite adjustment of the ambient light supplied to the reticle pattern 22 via the fluorescent fiber 152. Because the opening 158 may be positioned in virtually any position relative to the recess 68 and fluorescent fiber 152, a user may rotate the rotary dial 156 even miniscule amounts to adjust the amount of ambient light transmitted through the opening 158 and into the fluorescent fiber 152 and may similarly rotate the rotary dial 156 to account for changing ambient light conditions (i.e., transitioning from daytime to dusk, for example) to maintain a constant illumination of the reticle pattern 22. Adjustment of the illumination of the reticle pattern 22 is virtually limitless.

As noted above, the optical sight 10 may be used in dark conditions such as at night and/or in a dark building. Under such circumstances, when illumination of the reticle pattern 22 is required, ambient light is not readily accessible and the fluorescent fiber 152 may not be able to sufficiently illuminate the reticle pattern 22 even when the rotary dial 156 is positioned such that the opening 158 completely exposes the fluorescent fiber 152. Under such circumstances, it may be necessary to supplement the light transmitted by the fluorescent fiber 152 to the reticle pattern 22.

Figure 6:
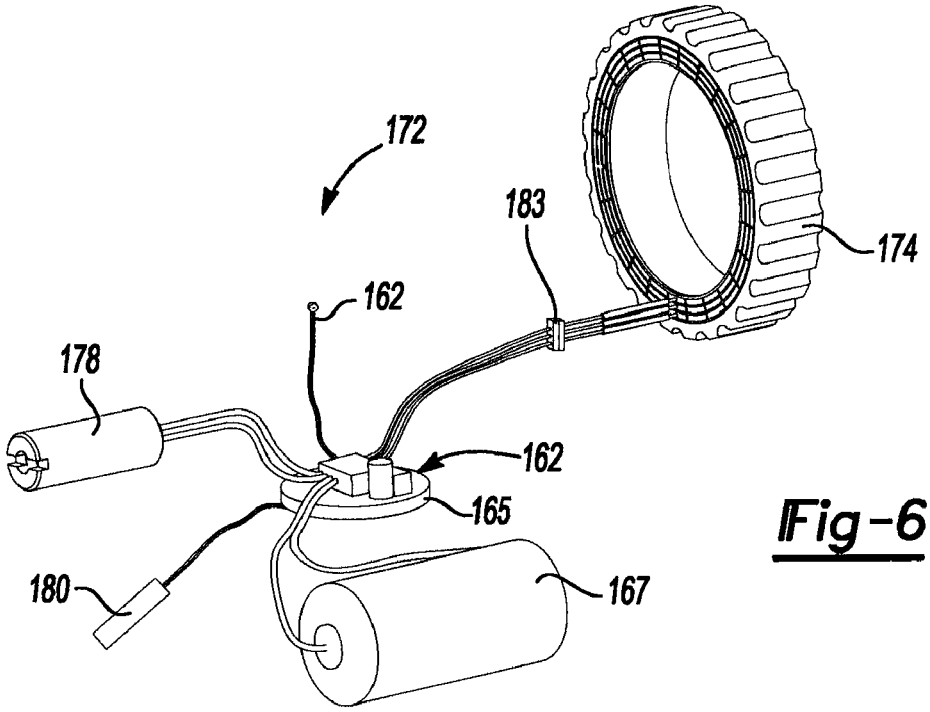
FIG. 6 is a perspective view of a control system for use with the optical sight of FIG. 1.

The illumination system 18 may also include a light-emitting diode 162 (LED), an electroluminescent film or wire, and/or a Tritium lamp 164 to further supplement the light supplied to the reticle pattern 22 by the fluorescent fiber 152 (FIG. 6). The LED 162, electroluminescent film or wire, and/or Tritium lamp 164 may be controlled by a control module 165 and may include a power source such as a battery 167.

With reference to FIG. 6, a control system 172 for use with the illumination system 18 is provided and includes a rotary switch, sleeve, or dial 174, a power source such as the battery 167, and a photo sensor and/or photodiode 178. The control system 172 may be in communication with the rotary device 174, which may include a plurality of positions that allow a user to control operation of the illumination system 18 by rotating the rotary device 174 relative to the housing 12. For example, the rotary device 174 may be moved into a position such that the illumination system 18 supplies light to the reticle pattern 22 solely by the fluorescent fiber 152 (i.e., the rotary device 174 is in an "OFF" position). Alternatively, the rotary device 174 may be positioned such that light is supplied to the reticle pattern 22 via the fluorescent fiber 152 in conjunction with the LED 162 using any of the configurations shown in FIGS. 7-39. The photo sensor and/or photodiode 178 may be used to automatically adjust an amount of light supplied to the reticle pattern 22 based on environmental conditions in which the optical sight 10 is used, and may also be assigned a position on the rotary device 174. The rotary device 174 may be positioned in any of the positions to allow a user to select between use of the LED 162, Tritium lamp 164, photo sensor and/or photodiode 178, and the OFF position, which limits light supplied to the reticle pattern 22 to only that which is supplied by the fluorescent fiber 152.

The battery 167 may be in communication with the LED 162 and/or photo sensor and/or photodiode 178. The battery 167 may supply the LED 162 and photo sensor and/or photodiode 178 with power. If the battery 167 is depleted, the Tritium lamp 164 may be used in conjunction with the fluorescent fiber 152 to illuminate the reticle 22. If the battery 167 is low, the control system 172 may blink a predetermined number of pulses on an initial start of the control system 172 to notify a user of the low-battery condition.

The control system 172 may also include a tape switch 180 that is an on/off switch that allows a user to control the illumination system 18. The tape switch 180 may be in communication with the control system 172 such that when the tape switch 180 is in an "ON" position, the control system 172 supplies the reticle pattern 22 with an amount of light in accordance with the position of the rotary device 174. For example, if the rotary device 174 is in a position whereby the LED 162 supplies light to the reticle pattern 22 in conjunction with the fluorescent fiber 152, turning the tape switch 180 to the ON position illuminates the reticle pattern 22 using the LED 162 and fluorescent fiber 152. Depressing the tape switch 180 into the OFF position shuts down the control system 172 and limits the light supplied to the reticle pattern 22 to only that which is supplied by the fluorescent fiber 152 and the Tritium lamp 164.

The rotary device 174 may include a pulse width modulated circuit and/or a resistive system associated with various settings of the rotary device 174. For example, when the rotary device 174 is positioned to use pulse width modulated (PWM) control, a PWM signal is supplied to the LED 162 to control the amount of light supplied by the LED 162 between 0% and 100% of a total illumination of the LED 162, depending on the signal supplied by the control system 172 to the LED 162. For example, the rotary device 174 may include five different PWM settings, whereby each setting increases the PWM signal supplied to the LED 162 by 20%. As the rotary device 174 is rotated between the various positions, the intensity of the LED 162 is increased and the illumination of the reticle pattern 22 is similarly increased.

In addition to using PWM control, the rotary device 174 may include a resistive, hall effect, reed switch, or magnetic switch system, whereby as the rotary device 174 is rotated relative to the housing 12, the illumination of the LED 162 is directly modulated and increased/decreased. Controlling the illumination of the LED 162 in such a fashion allows for infinite control of the LED 162 and therefore allows the reticle pattern 22 to be illuminated virtually at any level of illumination.

Figure 7:
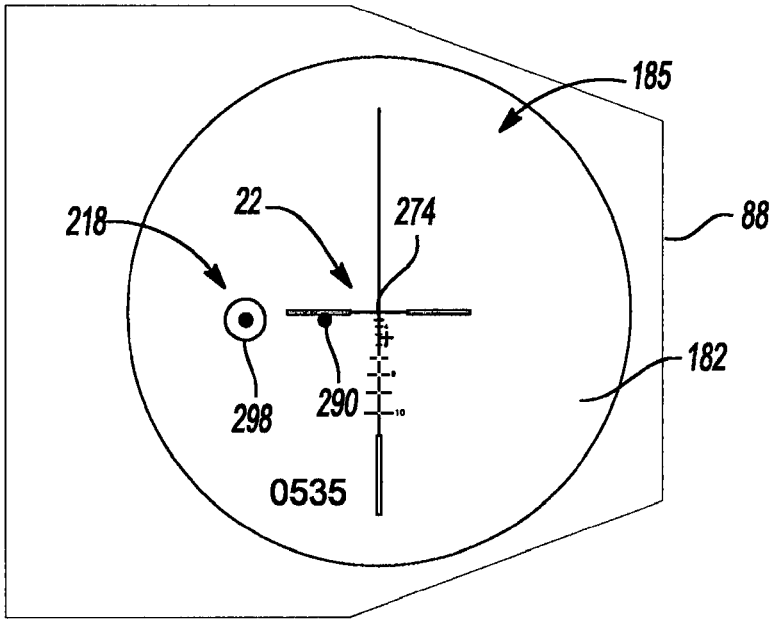
FIG. 7 depicts a reticle pattern of the optical sight of FIG. 3 including a display.
Figure 8:
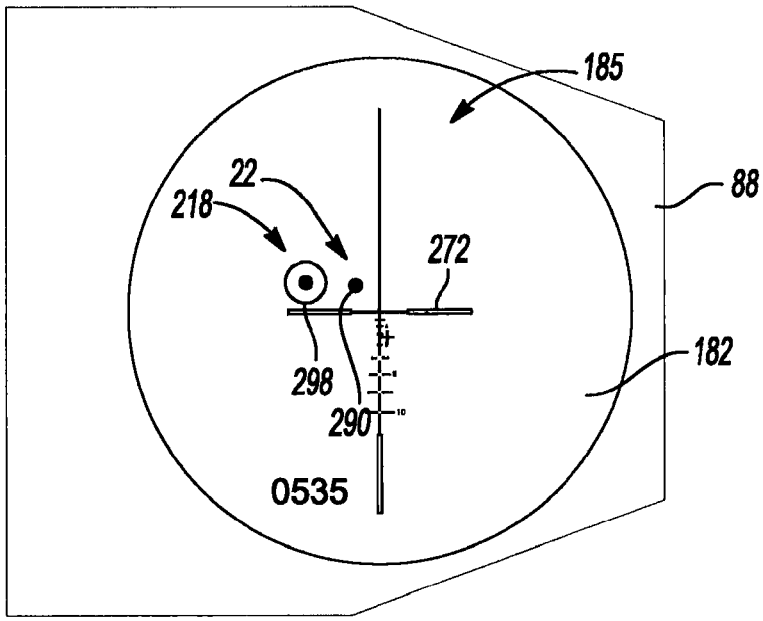
FIG. 8 depicts a reticle pattern of the optical sight of FIG. 3 including a display.
Figure 9:
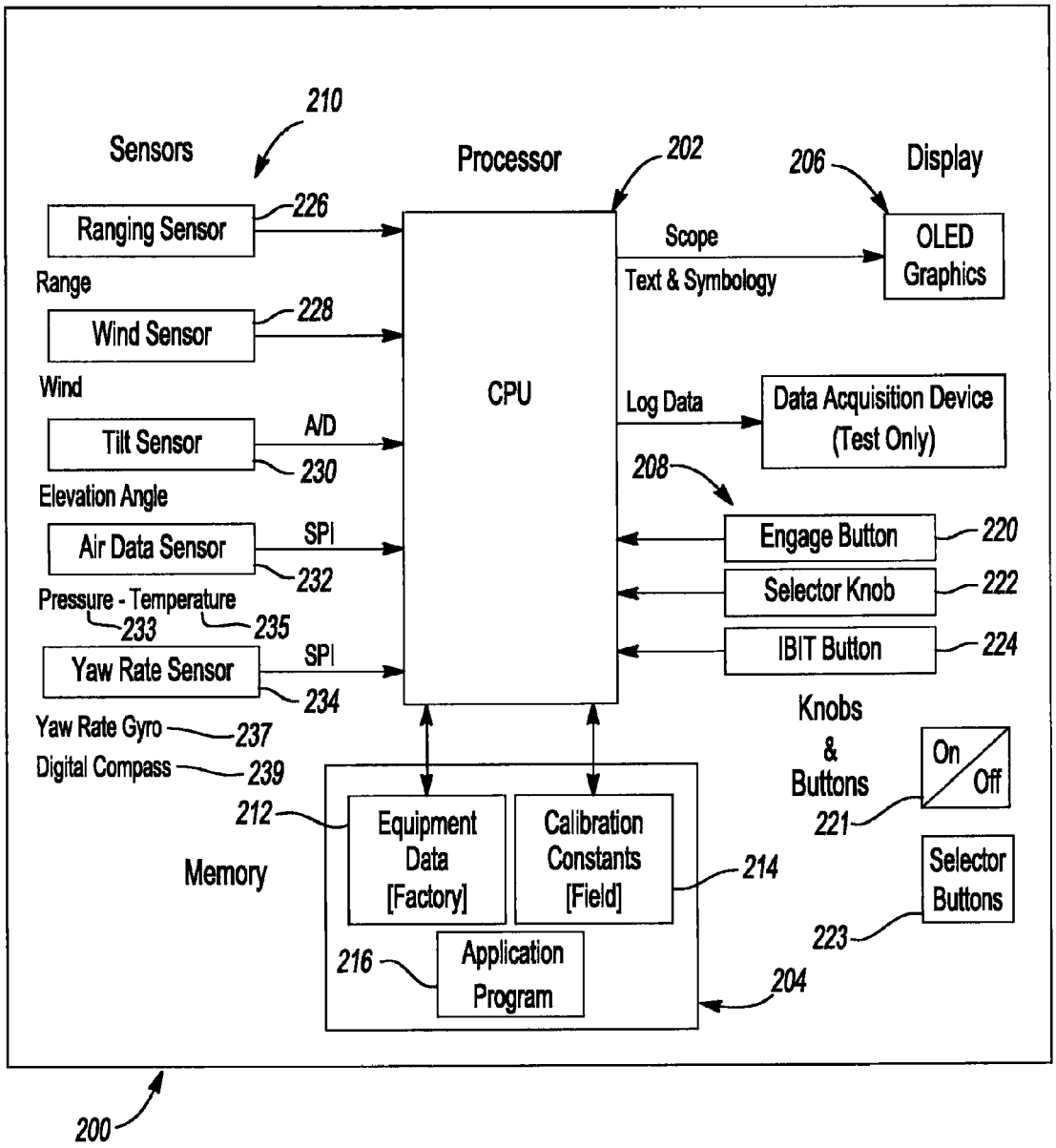
FIG. 9 is a schematic representation of an aiming system for use with the optical sight of FIG. 1.
Figure 10:
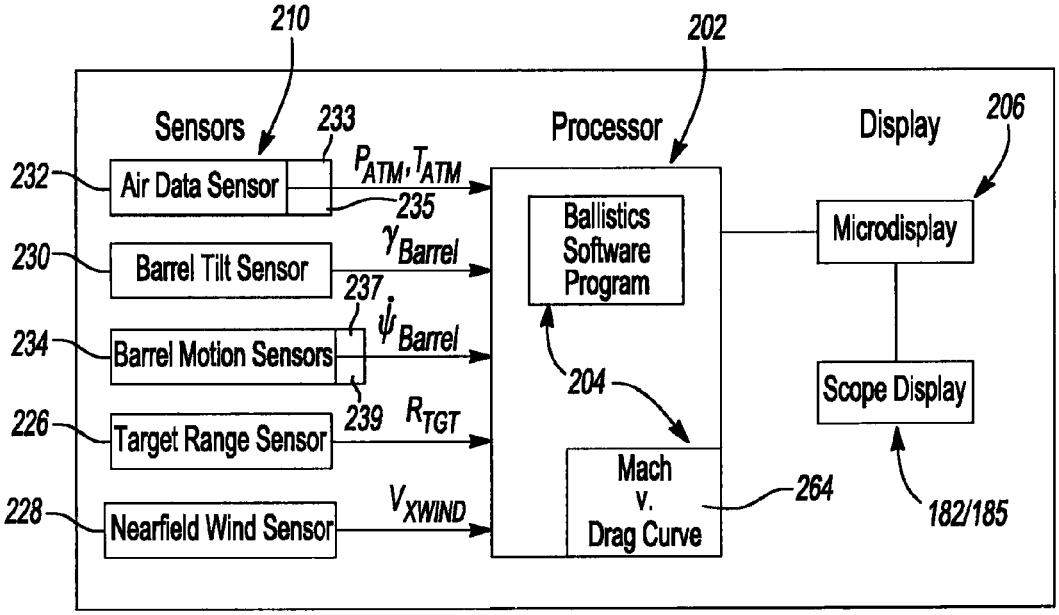
FIG. 10 is a schematic representation of a portion of the aiming system of FIG. 9.

With reference to FIGS. 7 and 8, the reticle 22 is shown in conjunction with a display 182, whereby each of the reticle 22 and display 182 are shown in a field-of-view 185 of the optical sight 10. The display 182 may be in communication with the control system 172 and may receive instructions from the control system 172. The control system 172 may supply the display 182 with data such as, for example, coordinates, range, text messages, and/or target-identification information such that a user may see the information displayed adjacent to the reticle 22. If the display 182 provides information relating to range, the optical sight 10 may also include a range finder (not shown) that provides such information. The display 182 may include an LED, a seven-segment display, or a liquid-crystal display (LCD) or any other digital ocular device for use in transmitting an image to the use of the optical sight 10.

The display 182 may be formed by removing a coating from a surface of the prism 88. For example, Aluminum may be removed from a surface of the prism to allow light to pass through the prism 88 where the material is removed—an exposed region. The exposed region may be coated with a dichroic coating to allow most ambient light to pass therethrough while restricting a predetermined color from passing through. For example, if information is displayed on the prism 88 in red, the dichroic coating would allow colors with wavelengths different than red to pass through the prism 88 to allow a user to see through the optical sight 10 even in the exposed region. If data is displayed in red, and red is not permitted to pass through the dichroic coating, the data may be displayed and viewed in the exposed region.

A pair of elastomeric electric contact connectors 183 may be supplied to provide power from the battery 167 and communication from the control module 165 to the rotary device 174, to allow communication of illumination setting signals from the rotary device 174 to the control module 165, which will control LED 162. The above configuration allows for a solid electrical connection between the eyepiece 64 and body 42 without the need to route wires between sealed mechanical separation points of the optical sight 10, the eyepiece 64, and the body 42.

External inputs or ports may be included on the housing 12 of the optical sight 10. For example, inputs or ports could be USB, firewire, Ethernet, wireless, infrared, rapid files, or any custom connection to allow a secondary or tertiary piece of equipment to communicate and display various information on the display 182. Such secondary pieces of equipment could be a laser-range finder, night-vision scope, thermal-imaging system, GPS, digital compass 239, wireless satellite uplink, military unit communication link, or friend/foe signal or auxiliary power supply.

In one configuration, the optical sight 10 may be connected to an aiming system 200 via the above-described inputs or ports to allow the aiming system 200 to communicate and display information on the display 182 and/or within the field-of-view 185 generally that aids a user in properly aligning the optical sight 10 with a stationary or moving target. While the aiming system 200 is described as being connected to the optical sight 10 via inputs or ports, the aiming system 200 may be constructed as an integral component of the optical sight 10 and, as such, may be contained within a shared housing 12 of the optical sight 10, as will be described with respect to FIGS. 19-28.

With particular reference to FIGS. 1 and 9-18, the aiming system 200 is shown to include a processor 202, a memory 204, a display 206, a series of user inputs 208, and a series of sensor inputs 210. The processor 202 is in communication with the memory 204, display 206, user inputs 208, and sensor inputs 210 and cooperates with the memory 204, user inputs 208, and sensor inputs 210 to provide the display 206 with information for use by a user in properly aligning the optical sight 10 with a stationary and/or moving target.

The processor 202 may be a microprocessor and may include a series of communication ports (not shown) for receiving information from the memory 204, the user inputs 208, and the sensor inputs 210. The memory 204 may provide the processor 202 with information related to at least one of the optical sight 10, the firearm 20, and a projectile or bullet fired by the firearm 20. In addition, the memory 204 may store an application program such as a ballistics software program (FIG. 10) for use by the processor 202. In one configuration, for example, the memory 204 may store equipment data 212 such as data relating to the optical sight 10, firearm 20, and projectile 21 (FIGS. 14 and 15), calibration constants 214 such as those related to zeroing of the optical sight 10 to the firearm 20, as well as application programs 216 that may be executed and run by the processor 202.

Figure 21:
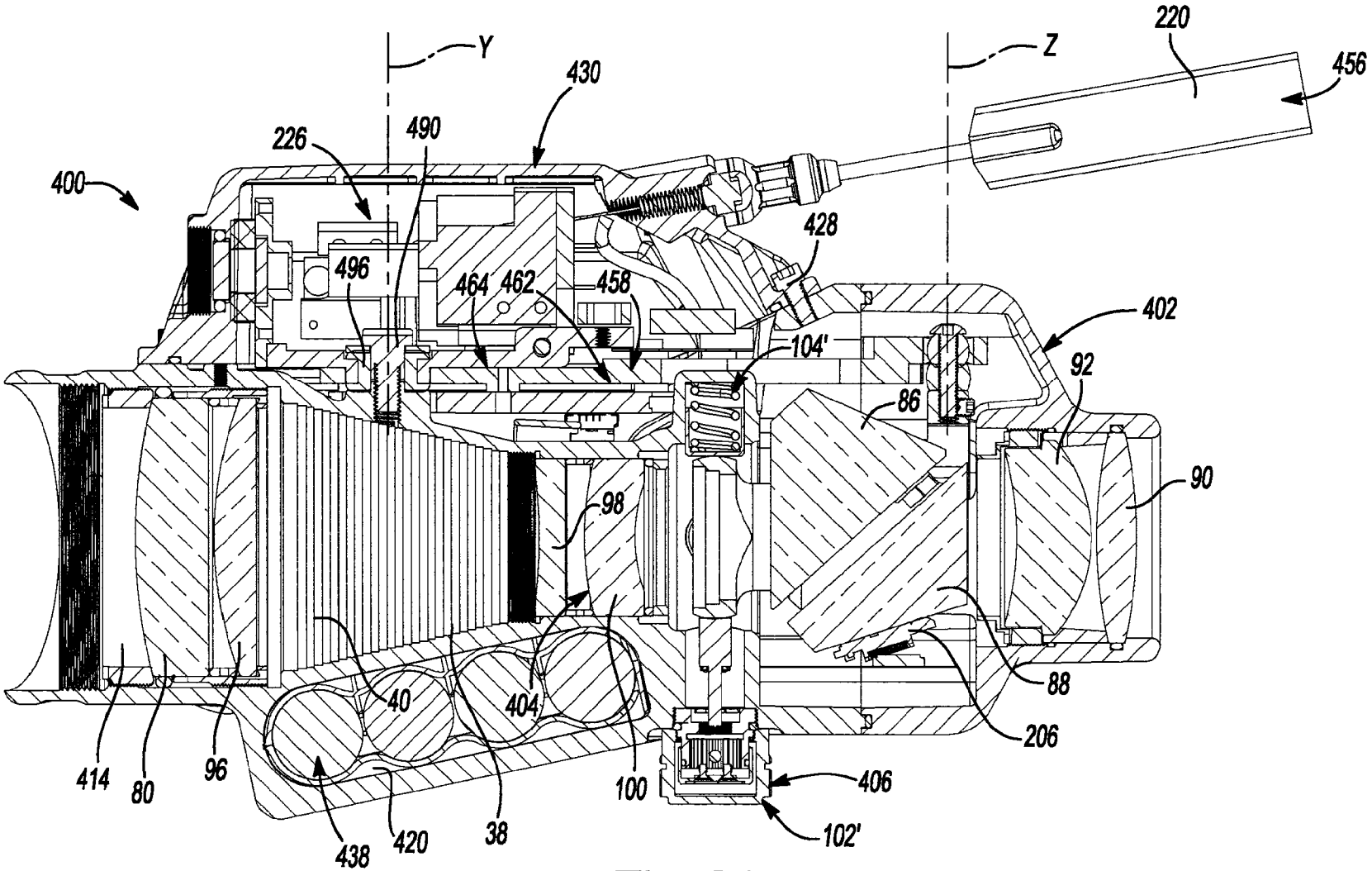
FIG. 21 is a cross-sectional view of the optical sight of FIG. 19 taken along line 21-21 of FIG. 19.

The display 206 may be in communication with an output port of the processor 202 and may receive information via the output port from the processor 202. The display 206 may be positioned proximate to or within an optical path of the optical sight 10 such that information on the display 206 may be viewed by a user within the field-of-view 185 of the optical sight 10. In one configuration, the display 206 may be positioned proximate to the mirror prism 88 (FIG. 21). Positioning the display 206 proximate to the mirror prism 88 allows information displayed on the display 206 to be viewed by a user within the field-of-view 185.

While the display 206 is shown as being used in conjunction with an optical sight 10 having a fluorescent fiber 152 and Tritium lamp 164, the display 206 could be used in conjunction with an optical sight having a non-illuminated reticle. In such an optical sight, the display 206 could be positioned proximate to the prism 88 in a similar fashion as shown in FIG. 3 to allow information displayed on the display 206 to be viewed by a user within the field-of-view 185.

The display 206 may be any suitable display such as, for example, a light-emitting device (LED), an organic light-emitting device (OLED), and a liquid-crystal display (LCD). Regardless of the particular location of the display 206 within the housing 12 of the optical sight 10 and the type of display implemented (LED, OLED, LCD, etc.), the display 206 may be utilized to display a corrected-aiming point 218 (FIGS. 7 and 8) within the field-of-view 185 of the optical sight 10 to aid a user in properly aligning the optical sight 10 and firearm 20 relative to a target. The display 206 may also provide additional information within the field-of-view 185 such as, for example, coordinates, range, text messages, and/or target-identification information, as described above with respect to display 182. Such information may be relayed to the display 182 via the processor 202 or may be displayed within the field-of-view 185 via display 206 in conjunction with the corrected-aiming point 218.

The user inputs 208 may include an engage button 220, an ON/OFF button 221, a selector knob 222, selector buttons 223, and an initiated built-in test (IBIT) button 224. Each of the engage button 220, ON/OFF button 221, selector knob 222, selector buttons 223, and IBIT button 224 may provide information to the processor 202 for use by the processor 202 in displaying information to the user in the field-of-view 185 via the display 206.

The sensor inputs 210 may be in communication with the processor 202 via a series of interfaces such as, for example, a serial-peripheral interface (SPI) and/or an A/D interface to allow the sensor inputs 210 to provide information to the processor 202. In one configuration, the sensor inputs 210 may include a range sensor 226, a wind sensor 228, a tilt sensor 230, an air-data sensor 232, and a motion sensor 234.

The range sensor 226, wind sensor 228, tilt sensor 230, air-data sensor 232, and motion sensor 234 may be disposed within or proximate to the housing 12 of the optical sight 10 or, alternatively, may be disposed in a separate housing 236 (FIG. 1) proximate to the housing 12 of the optical sight 10. Regardless of the particular location of the sensors 226, 228, 230, 232, 234, each sensor 226, 228, 230, 232, 234, supplies the processor 202 with information regarding environmental conditions and/or orientation of the firearm 20.

The range sensor 226 provides the processor 202 with information regarding a distance to a particular target. The range sensor 226 may transmit a laser beam to a target once initiated and may determine the distance to the target from the optical sight 10 based on a time in which a return signal from the target is received and may therefore be a so-called "laser-range finder." While the processor 202 is described as being associated with the range sensor 226, the processor 202 could additionally or alternatively receive range information from a remote location (i.e., via a satellite, for example) and/or may be manually input via one of the user inputs 208.

Figure 19:
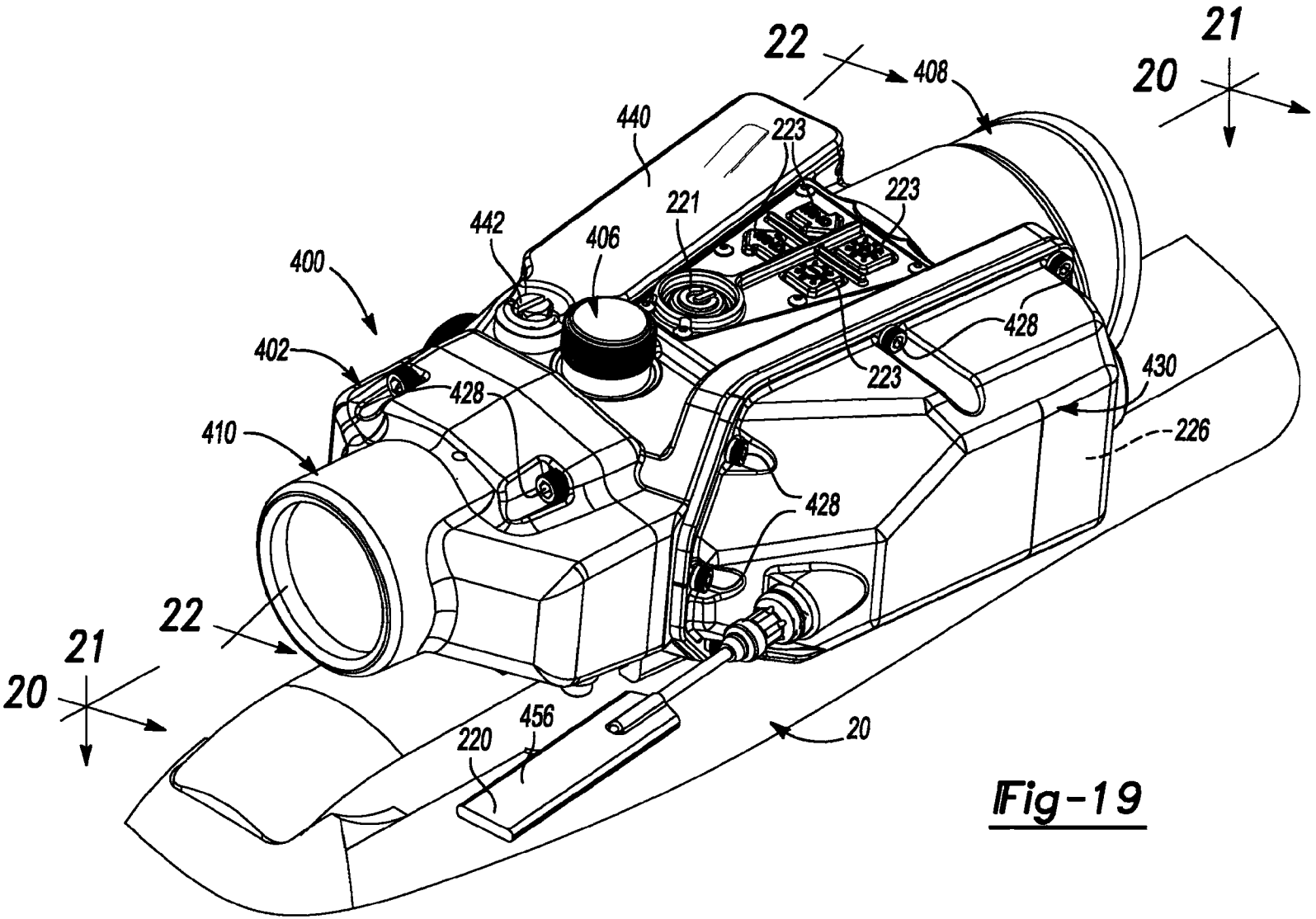
FIG. 19 is a partial perspective view of a firearm incorporating an optical sight and aiming system in accordance with the principles of the present disclosure.
Figure 20:
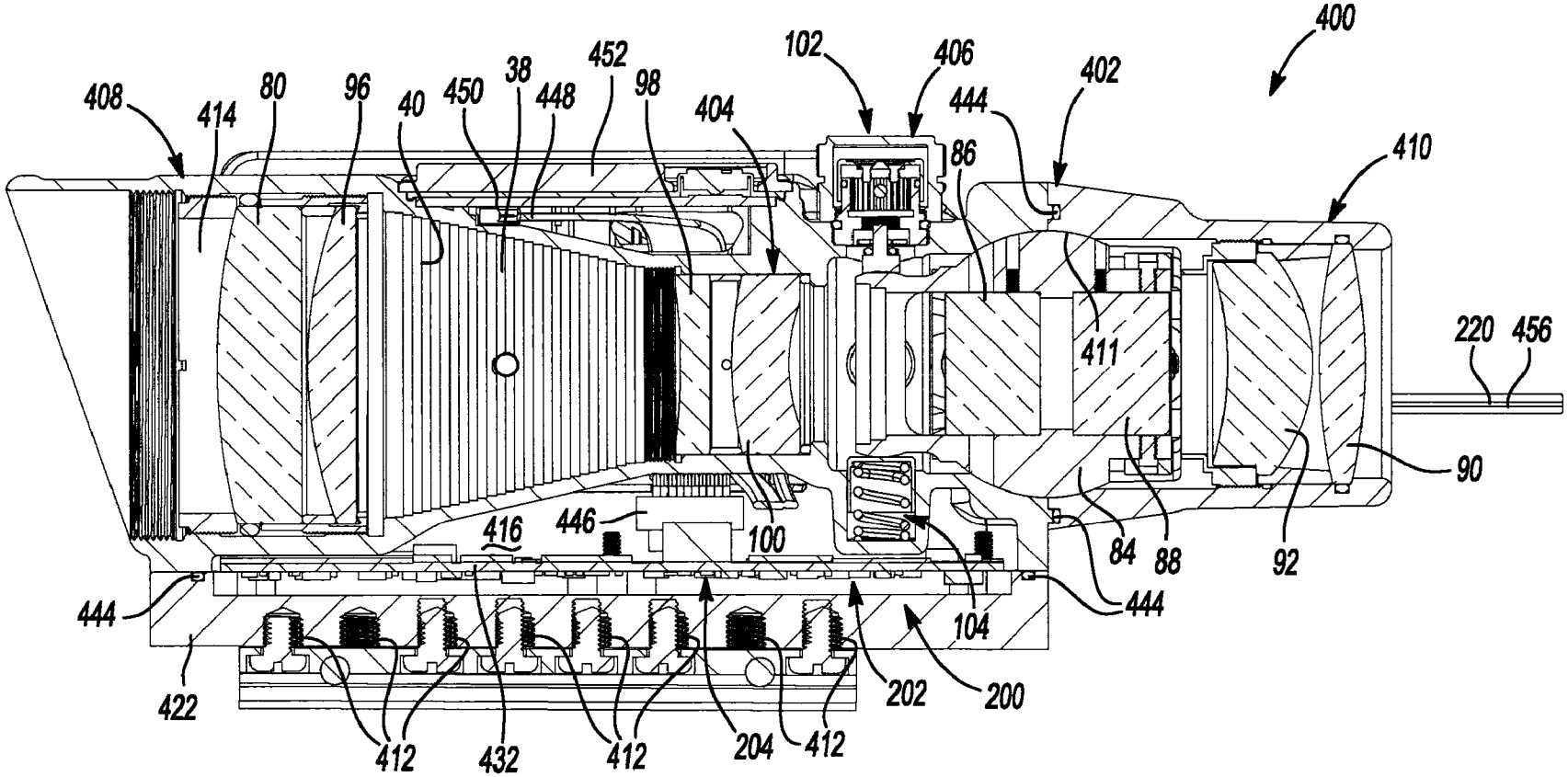
FIG. 20 is a cross-sectional view of the optical sight of FIG. 19 taken along line 20-20 of FIG. 19.

The wind sensor 228 may detect wind conditions including direction and velocity proximate to the optical sight 10 and may supply information to the processor 202 for use by the processor 202 in determining a trajectory of the projectile 21. While the sensor inputs 210 are described as including a wind sensor 228, the processor 202 could additionally or alternatively receive information regarding wind conditions proximate to the optical sight 10 via an external source (i.e., via broadcast weather data, for example) and/or may be manually input via the user inputs 208 at selector buttons 223 (FIG. 19).

The air-data sensor 232 may include a pressure sensor 233 and a temperature sensor 235 to determine atmospheric pressure proximate to the optical sight 10 as well as ambient temperature conditions proximate to the optical sight 10. The pressure data detected by the pressure sensor 233 and the temperature data detected by the temperature sensor 235 may be transmitted to the processor 202 for use by the processor 202 in determining an air density proximate to the optical sight 10 for use in determining a mach number and, ultimately, a trajectory of the projectile 21 when fired from the firearm 20.

While the air-data sensor 232 is described as including a pressure sensor 233 and a temperature sensor 235, the air-data sensor 232 could alternatively include either a single pressure sensor 233 or a single temperature sensor 235. If the air-data sensor 232 only includes a pressure sensor 233, the processor 202 may determine an approximate temperature value based on information received from the pressure sensor 233. Likewise, if the air-data sensor 232 only includes a temperature sensor 235, the processor 202 can determine an approximate pressure value based on the temperature data received from the temperature sensor 235. While the air-data sensor 232 is described as including at least one of a pressure sensor 233 and a temperature sensor 235, atmospheric pressure and/or ambient temperature conditions may be additionally or alternatively received from an external source such as, for example, broadcast weather data and/or may be manually input via the user inputs 208.

The tilt sensor 230 and the motion sensor 234 provide the processor 202 with information relating to a position of the firearm 20. Specifically, the tilt sensor 230 provides information to the processor 202 regarding the tilt of a barrel 19 of the firearm 20. The motion sensor 234 may include at least one of a yaw rate gyroscope 237 and a digital compass 239 to provide the processor 202 with information regarding the yaw of a barrel 19 of the firearm 20. The motion sensor 234 may include both the yaw rate gyroscope 237 and digital compass 239, whereby the digital compass 239 is used to validate information received from the yaw rate gyroscope 237. Specifically, the digital compass 239 may be used to filter out noise associated with operation of the yaw rate gyroscope 237 to allow the motion sensor 234 to provide accurate information to the processor 202 regarding the yaw rate of the barrel 19 of the firearm 20.

With particular reference to FIGS. 11-18, operation of the aiming system 200 will be described in detail. When the optical sight 10 is initially attached to the firearm 20, the optical sight 10 must be calibrated to account for the offset between the barrel 19 of the firearm 20 and the reticle 22 of the optical sight 10. The calibration process may be referred to as "zeroing" of the optical sight 10, as the offset between a longitudinal axis of the optical sight 10 and that of the barrel 19 of the firearm 20 is essentially reduced to "zero" via movement of the position of the reticle 22 relative to the housing 12 of the optical sight 10.

To begin calibration of the optical sight 10, the optical sight 10 is initially installed on the firearm 20 and the firearm 20 is aimed at a target positioned at a known distance relative to the firearm 20. A position of the reticle 22 relative to the housing 12 may be adjusted by manipulating the adjustment system 16 to position the optics train 14 relative to the housing 12, as discussed above. Once the reticle 22 is positioned relative to the housing 12 such that alignment of the reticle 22 with the target results in a projectile 21 striking the target at a desired location, calibration of the optical sight 10 is complete.

Once the optical sight 10 is properly calibrated or "zeroed," the user may depress the engage button 220 while aiming the reticle 22 of the optical sight 10 at a desired impact location. Depressing the engage button 220 causes the processor 202 to store the zero-range barrel tilt ($\theta_{zero}$) and zero-range barrel \-zero, yaw ($\psi_{zero}$) in the memory 204. At this point, the corrected-aiming point 218 determined by the processor 202 and displayed by the display 206 should be coincident with the reticle 22 of the optical sight 10. The zero-range barrel tilt and the zero-range barrel yaw are utilized by the processor 202 as the baseline when determining the corrected-aiming point 218 for a stationary-target solution or a moving-target solution to prevent the offset between the longitudinal axis of the optical sight 10 and that of the barrel 19 of the firearm 20 from generating an inaccurate corrected-aiming point 218.

Following calibration or "zeroing" of the optical sight 10 and storing of the zero-range barrel tilt and zero-range barrel yaw in the memory 204, a user may then rely on the aiming system 200 to properly align the optical sight 10 and, thus, the barrel 19 of the firearm 20 relative to a stationary target and/or a moving target to accurately strike the stationary target or moving target with a projectile 21.

Figure 11:
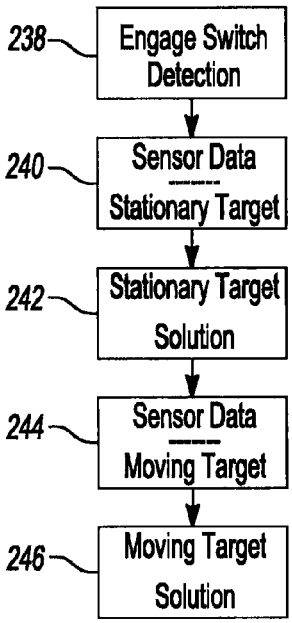
FIG. 11 is a flowchart detailing operation of the aiming system of FIG. 9.

With reference to FIG. 11, the user initially depresses the engage button 220 at 238, which alerts the processor 202 that a corrected-aiming point 218 is desired by the user. Depressing the engage button 220 causes the processor 202 to poll the sensors 226, 228, 230, 232, 234 to obtain information from the sensors 226, 228, 230, 232, 234 at 240 regarding environmental conditions proximate to the optical sight 10 and barrel-position data of the firearm 20. The processor 202 may use the sensor data obtained at 240 to generate a stationary-target solution at 242 to aid the user in properly aligning the firearm 20 with a stationary target. Once the processor 202 determines the stationary-target solution at 242, the processor 202 may display the corrected-aiming point 218 on the field-of-view 185 via the display 206 to aid the user in properly aligning the optical sight 10 and, thus, the barrel 19 of the firearm 20 relative to the stationary target. The corrected-aiming point 218 directs the user how to position the barrel 19 of the firearm 20 relative to the stationary target to allow a projectile 21 fired by the firearm 20 to strike the target at a desired location. Specifically, the user aligns the corrected-aiming point 218 with the target rather than aligning the fixed reticle 22 with the target to more accurately position the barrel 19 of the firearm 20 and increase the likelihood that a projectile 21 fired from the firearm 20 will strike the stationary target at a desired location.

Should the processor 202 determine that the target is a moving target based on information received from the motion sensor 234 at 244, the processor 202 will display a corrected aiming point 218 based at least in part on the speed with which the target is moving at 246 to sufficiently lead the target and increase the likelihood that a projectile 21 fired from the firearm 20 hits the moving target at a desired location.

Figure 12:
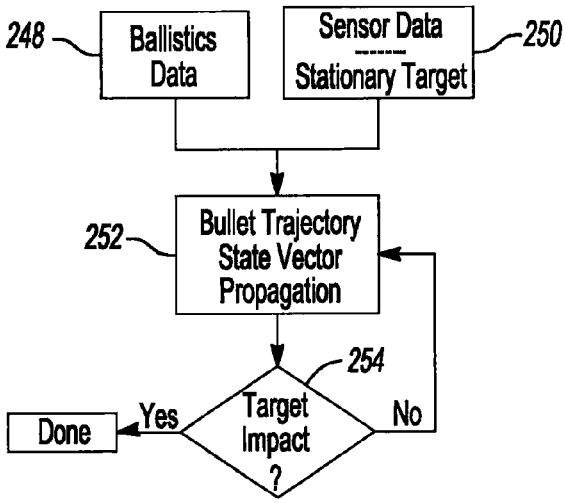
FIG. 12 is a flowchart detailing operation of the aiming system of FIG. 9 in conjunction with operation of a weapon.

With particular reference to FIG. 12, the processor 202 may determine the stationary-target solution at 242 (FIG. 11) or the moving-target solution 246 (FIG. 11) based on ballistics data received at 248 and sensor data received at 250. The processor 202 may rely on the ballistics data received at 248 and the sensor data received at 250 to determine a simulated projectile or bullet trajectory and simulated projectile or bullet impact location at 252. The simulated bullet impact location may be compared to a known target location obtained when the optical sight 10 is aimed at a target and the engage button 220 is depressed, thereby causing the range sensor 226 to determine a distance of the target from the optical sight 10.

If the simulated bullet trajectory yields a simulated bullet impact that hits the target at a desired location at 254, the corrected-aiming point 218 is displayed and the process is complete. If the simulated bullet impact does not hit the target at a desired location, the processor 202 continuously determines simulated bullet trajectories and simulated bullet impact locations in a closed-loop or iterative process until the simulated bullet trajectory results in a simulated bullet impact that causes a bullet or projectile 21 fired from the firearm 20 to strike the target at the known position of the target based on information received from the range sensor 226, as will be described in detail below. While the terms "bullet" trajectory and "bullet" impact location will be used hereinafter and in the drawings, the present disclosure is not limited to "bullets" per se and is applicable to any projectile or ordinance.

Figure 13:
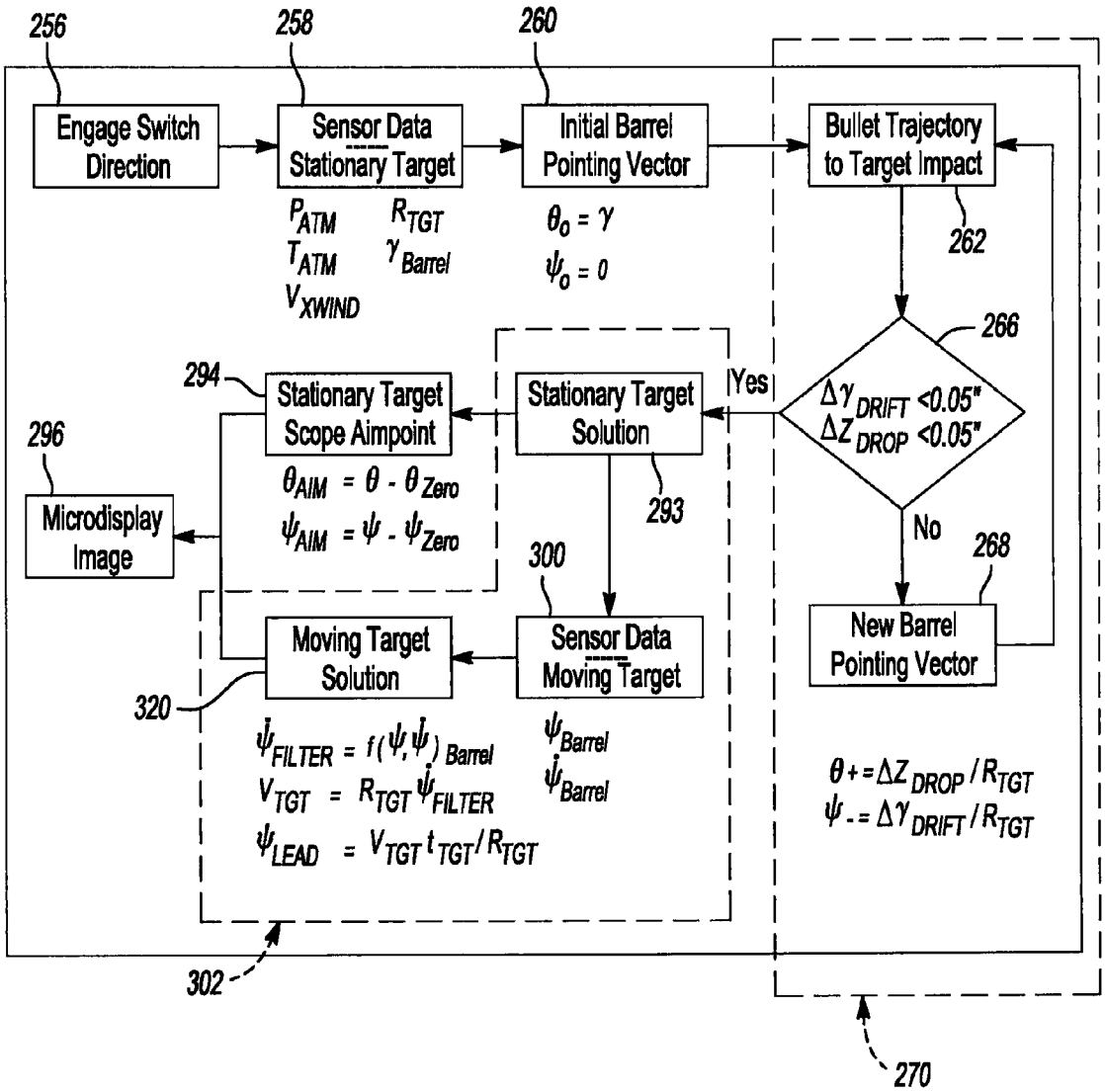
FIG. 13 is a flowchart detailing operation of the aiming system of FIG. 9.
Figure 14:
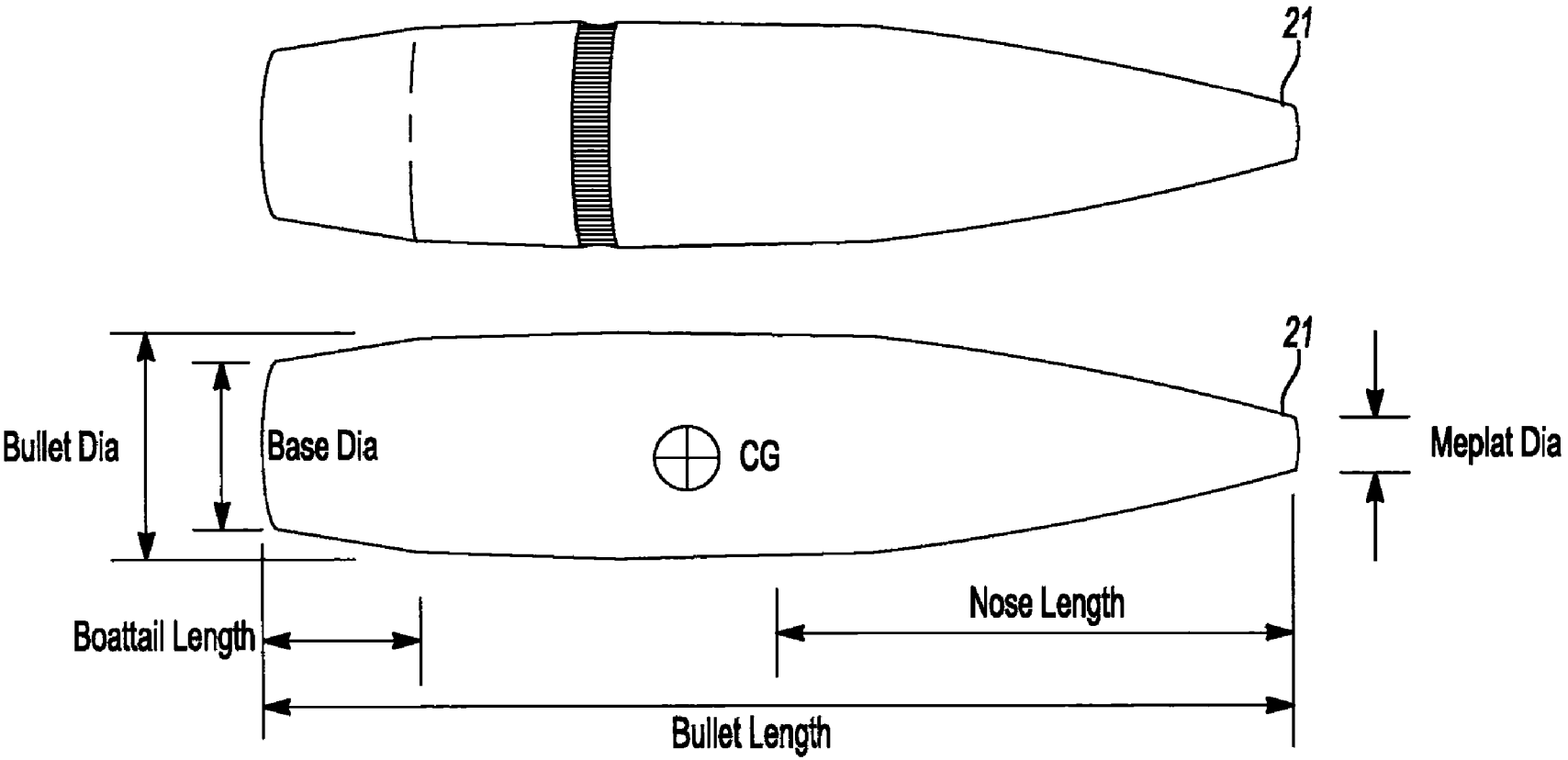
FIG. 14 is a side view of a projectile and a schematic representation of a projectile identifying parameters of the projectile that may be used by the aiming system of FIG. 9 in calculating a trajectory of the projectile.
Figure 15:
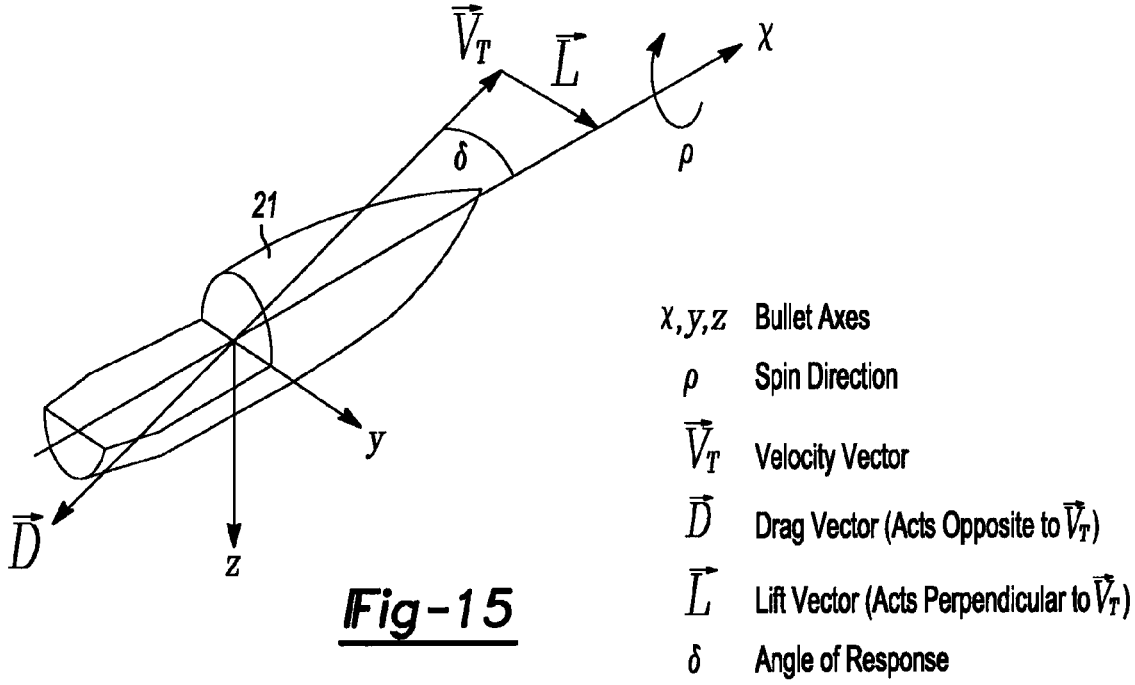
FIG. 15 is a partial prospective and cutaway view of the projectile of FIG. 14 showing various parameters of the projectile that may be used by the aiming system of FIG. 9 in calculating a trajectory of the projectile.
Figure 16:
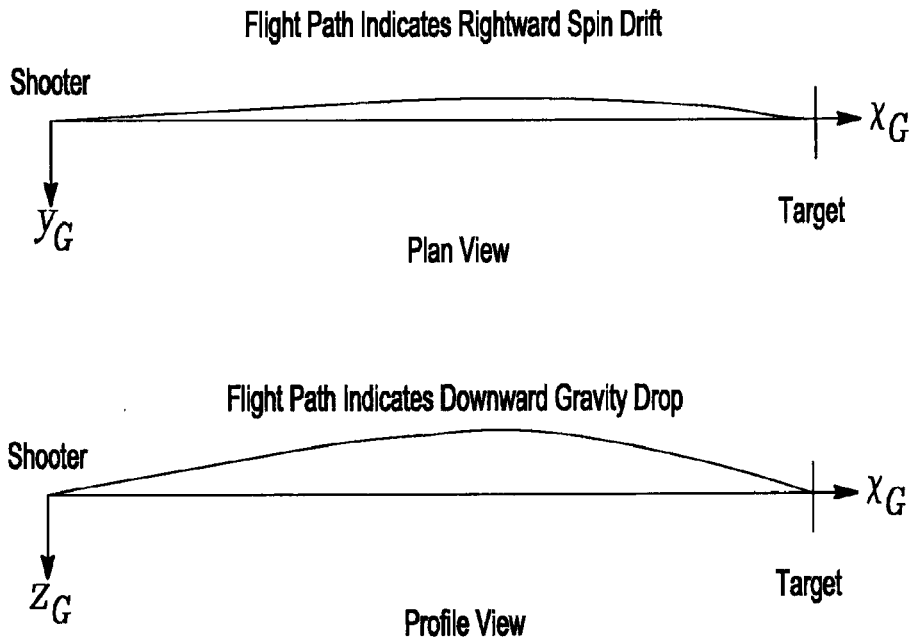
FIG. 16 is a schematic representation of a flight path of the projectile of FIG. 14 in a plan view and a profile view.
Figure 17:
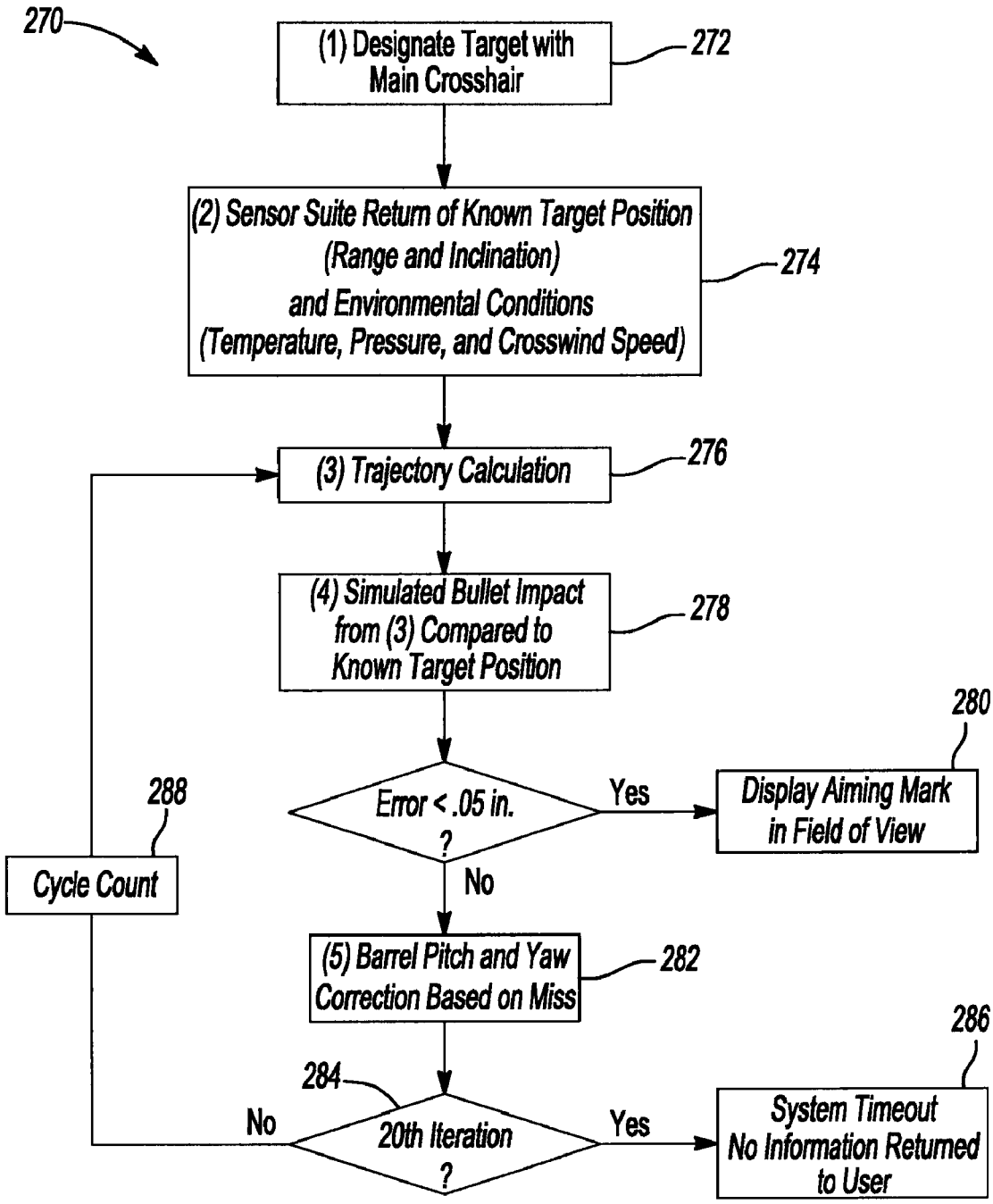
FIG. 17 is a flowchart detailing operation of the aiming system of FIG. 9 in a stationary-target mode.

With particular reference to FIG. 13, when a user depresses the engage button 220 at 256, the processor 202 is alerted that the user requires a corrected-aiming point 218 be displayed within the field-of-view 185. The processor 202 polls each of the sensors 226, 228, 230, 232, 234 to receive sensor data at 258 relating to atmospheric pressure ($P_{ATM}$), atmospheric temperature ($T_{ATM}$), crosswind speed ($V_{XWIMD}$), target range ($R_{TGT}$), and barrel tilt angle ($\gamma_{BARREL}$). The atmospheric pressure and atmospheric temperature are received from the pressure sensor 233 and temperature sensor 235, respectively, of the air-data sensor 232 while the crosswind speed is received from the wind sensor 228. The target range is obtained when the firearm 20 and optical sight 10 are pointed at the desired target and the range sensor 226 is allowed to determine a range from the range sensor 226 to the desired target.

In addition to the sensor data received at 258, the initial barrel pointing vector ($\theta_0$, $\psi_0$) may be determined at 260 based on information received from the tilt sensor 230. The processor 202 may then utilize information received at 258 from the sensors 226, 228, 230, 232, 234 and the initial barrel pointing vector determined at 262 to determine a simulated bullet trajectory and simulated bullet impact location that would allow the projectile 21 to impact the target at a desired location when fired from the firearm 20 at 262.

Once the engage button 220 is depressed and the sensor data and initial barrel pointing vector received, the processor 202 polls the memory 204 to obtain information regarding the firearm 20, projectile 21, drag coefficient, and weapon twist rate. Specifically, the processor 202 receives information from the memory 204 regarding the projectile 21 such as the spin direction (p). The processor 202 may then determine the drag coefficient of the projectile 21 as well as the velocity vector ($\vec{V}_T$), the drag vector ($\vec{D}$), the lift vector ($\vec{L}$), and the angle of repose ($\delta$) (FIG. 15) based on data received from the sensors 226, 228, 230, 232, 234 as well as information retrieved from the memory 204. Specifically, the processor 202 may retrieve information from the memory 204 regarding the initial muzzle velocity based on the particular projectile 21 and particular firearm 20 being used. The initial muzzle velocity may be divided by the speed of sound to determine the mach number for the projectile 21. The speed of sound may be determined by the processor 202 by first determining the density of air based on information received from the pressure sensor 233 and temperature sensor 235 of the air-data sensor 232 and, as such, is representative of the current environmental conditions surrounding the optical sight 10 and firearm 20.

A relationship of mach number versus drag coefficient for various projectiles 21 may be stored in the memory 204. For example, a mach versus drag curve 264 (FIG. 10) may be stored in the memory 204 for use in determining a drag coefficient at a particular mach number. While a mach versus drag curve 264 is described as being stored in the memory 204, a look-up table of mach numbers and corresponding drag coefficients may additionally or alternatively be stored in the memory 204 for use by the processor 202 in determining a drag coefficient for a particular mach number. Regardless of the particular data stored in the memory 204 (i.e., a curve versus a look-up table), the processor 202 obtains a drag coefficient for the particular projectile 21 at the determined mach number and then calculates an initial simulated bullet trajectory and initial simulated bullet impact location by utilizing a numerical computation of the Modified Point Mass Equations, as set forth in *Modern Exterior Ballistics* (Robert L. McCoy, (Atglem, PA: Shiffer, 1999), 214). The numerical computation relies on the drag coefficient obtained from the memory 204, as well as information received from the range sensor 226, the wind sensor 228, the tilt sensor 230, and the motion sensor 234 in generating the simulated bullet trajectory and simulated bullet impact location.

The initial simulated bullet trajectory and initial simulated bullet impact location are based on the current position of the barrel 19 of the firearm 20, which extends in a substantially straight line towards the desired target to allow the range sensor 226 to supply the desired range information to the processor 202. Because the initial bullet trajectory and initial bullet impact location are based on this initial position of the barrel 19 of the firearm 20, the bullet trajectory and bullet impact location determined initially at 262 will likely not result in a projectile 21 fired from the firearm 20 in striking the target at a desired location. The initial simulated bullet impact location is therefore compared to the known target location (as reported and known based on information received from the range sensor 226 when the engage button 220 is depressed) to determine if the simulated bullet impact location would result in the projectile 21 striking the target at a desired location.

If the simulated bullet impact location is within approximately 0.05 inches of the target location in both the drop (vertical) and drift (horizontal) directions (FIG. 16), then the current barrel tilt is saved as the final barrel tilt ($\theta_f$) and the current barrel yaw is saved as the final barrel yaw ($\theta_f$). Should the first simulated bullet trajectory result in a simulated bullet impact location that allows the bullet impact error to be within the desired 0.05 inches of target location in both the drop (vertical) and the drift (horizontal) directions, then the zero-range barrel tilt ($\theta_o$) and the zero-range barrel yaw ($\psi_0$) are respectively subtracted from the final barrel tilt ($\theta_f$) and the final barrel yaw ($\psi^f$) to obtain the desired barrel tilt ($\theta_s$) and the desired barrel yaw ($\psi_f$) that will result in a projectile 21 being fired from the firearm 20.

The aiming system 200 aides the user in positioning the firearm 20 at the desired barrel tilt ($\theta_s$) and barrel yaw ($\psi_s$) by displaying the corrected-aiming point 218 in the field-of-view 185. The corrected aiming point 218 instructs the user where to move the firearm 20 position such that the position of the firearm 20 coincides with the barrel tilt ($\theta_s$) and the barrel yaw ($\psi_s$). Specifically, the corrected-aiming point 218 is positioned within the field-of-view 185 relative to the reticle 22 to allow the user to align the corrected-aiming point 218 with the target and in so doing, causes the firearm 20 to be positioned such that the barrel tilt and the barrel yaw are substantially equal to the desired barrel tilt ($\theta_s$) and the desired barrel yaw ($\psi_s$). Positioning the firearm 20 in this regard causes the projectile 21 fired from the firearm 20 to strike the target at a desired location. If the bullet error is determined to be greater than approximately 0.05 inches in either the drop (vertical) or the drift (horizontal) directions, at 266, the processor 202 determines a new barrel pointing vector at 268 for use by the processor 202 in determining a second simulated bullet trajectory and a second simulated bullet impact location at 262.

The processor 202 may compare the second simulated bullet impact location to the known target location to determine whether the second bullet impact location is within approximately 0.05 inches in both the drop and drift directions at 266. If the second simulated bullet trajectory is within approximately 0.05 inches in both the drop and drift directions at 266, the processor 202 displays the corrected-aiming point 218 in the field-of-view 185 via the display 206. If the second simulated bullet trajectory is not within approximately 0.05 inches in both the drop and drift directions, a new barrel pointing vector is determined at 268 and a third simulated bullet trajectory and third simulated bullet impact location are determined.

The foregoing process of determining an initial simulated bullet trajectory/impact location and subsequent (i.e., second, third, etc.) simulated bullet trajectories/impact locations is an iterative process, whereby the processor 202 continually determines simulated bullet trajectories/impact locations until a bullet impact location is determined that allows a projectile 21 fired from the firearm 20 to strike a target at a desired location. The iterative process is identified by reference numeral 270 in FIG. 13 and will be described in detail with respect to FIG. 17.

As described above, a user initially aims the optical sight 10 and firearm 20 at a target using the reticle 22 at 272. Once the target is viewed within the field-of-view 185 such that the reticle 22 is aligned with the target, the user depresses the engage button 220, thereby causing the processor 202 to poll the sensors 226, 228, 230, 232, 234 and the memory 204 at 274. The processor 202 then determines a first simulated bullet trajectory based on the position of the firearm 20, as determined by the tilt sensor 230 when the engage button 220 is depressed and the reticle 22 is aligned with the target at 276. A first simulated bullet impact location is then determined and is compared to the known target position determined when the reticle 22 is aligned with the target and the engage button 220 is depressed at 278.

If the first simulated bullet trajectory results in a simulated bullet impact that is within approximately 0.05 inches of the target location in both the drop (vertical) and drift (horizontal) directions, the processor 202 displays the corrected-aiming point 218 in the field-of-view 185 at 280. If the simulated bullet impact associated with the first simulated bullet trajectory is not within substantially 0.05 inches of the target location in either of the drop direction or the drift direction, the processor 202 corrects the barrel pitch and yaw at 282 and checks whether nineteen (19) simulated bullet trajectories and associated simulated bullet impact locations have been performed at 284. If nineteen (19) simulated bullet trajectories and associated simulated bullet impact locations have been determined, the processor 202 times out and no information is returned to the user at 286. If, however, the number of simulated bullet trajectories and simulated bullet impact locations is less than nineteen (19), the cycle count is incremented by one at 288 and the process begins anew, whereby the processor 202 once again determines another simulated bullet trajectory at 276 and determines another simulated bullet impact at 278. While nineteen (19) simulated bullet trajectories and simulated bullet impact locations are described, nineteen (19) iterations is exemplary and, as such, the processor 202 could rely on any number of iterations before timing out including less than or more than nineteen (19).

The foregoing iterative process 270 continues until the simulated bullet impact location determined at 278 is within substantially 0.05 inches of the known target location in both the drop direction and the drift direction or twenty (20) such simulated bullet impact locations have been determined without resulting in a simulated bullet impact location that is within substantially 0.05 inches in both the drop direction and the drift direction. If a simulated bullet impact location is determined that is within substantially 0.05 inches in both the drop direction and the drift direction, the processor 202 displays the corrected-aiming point 218 in the field-of-view 185 via the display 206 that causes a user to position the barrel 19 of the firearm 20 such that a projectile 21 fired therefrom will impact the target at a desired location.

With continued reference to FIG. 13, once the simulated bullet impact location is determined at 278, the processor 202 polls the motion sensor 234 to determine if the user is moving the firearm 20. The motion sensor 234 returns information as to whether the user is moving the firearm 20 to determine whether the desired target is a stationary target or a moving target. If the motion sensor 234 indicates that the firearm 20 is moving, the processor 202 determines the moving target solution at 320. The processor 202 then determines a location of the corrected-aiming point 218 at 294 and displays the corrected-aiming point 218 via the display 206 at 296.

The processor 202 may display the corrected-aiming point 218 as a solid dot or other shape 290 (FIGS. 7 and 8) to indicate to the user that the solution determined by the aiming system 200 is for a stationary target rather than a moving target. As will be described in detail below, the processor 202 may display a different corrected-aiming point 218 for a moving-target solution to differentiate between a stationary target and a moving target. For example, the processor 202 may display a similar dot or shape as a stationary target but may surround the dot or shape with a line 298 (FIGS. 7 and 8) to differentiate a moving-target solution from a stationary-target solution. While the corrected-aiming point 218 is described as being a solid dot or shape 294 for a stationary-target solution and the corrected-aiming point 218 is described as being a similar dot or other shape having a line 298 surrounding the dot or shape for a moving-target solution, any indicia may be used for the stationary-target solution and the moving-target solution that allows a user to differentiate between the stationary-target solution and the moving-target solution. Furthermore, while the corrected-aiming point 218 is described as including a different shape for each of the moving-target solution and the stationary-target solution, the corrected-aiming point 218 may include the same or identical shape and may be illuminated with a different color to differentiate between a moving-target solution and a stationary-target solution. Further yet, while the corrected-aiming point 218 is described as including a different shape and/or a different color for a stationary-target solution and a moving-target solution, the corrected-aiming point 218 may include the same shape and the same color for each of the moving-target solution and the stationary-target solution. The aiming system 200 may allow a user to adjust these parameters to tailor the shape and/or color of the corrected-aiming point 218 for each of the moving-target solution and the stationary-target solution to allow the user to customize the aiming system 200.

Figure 18:
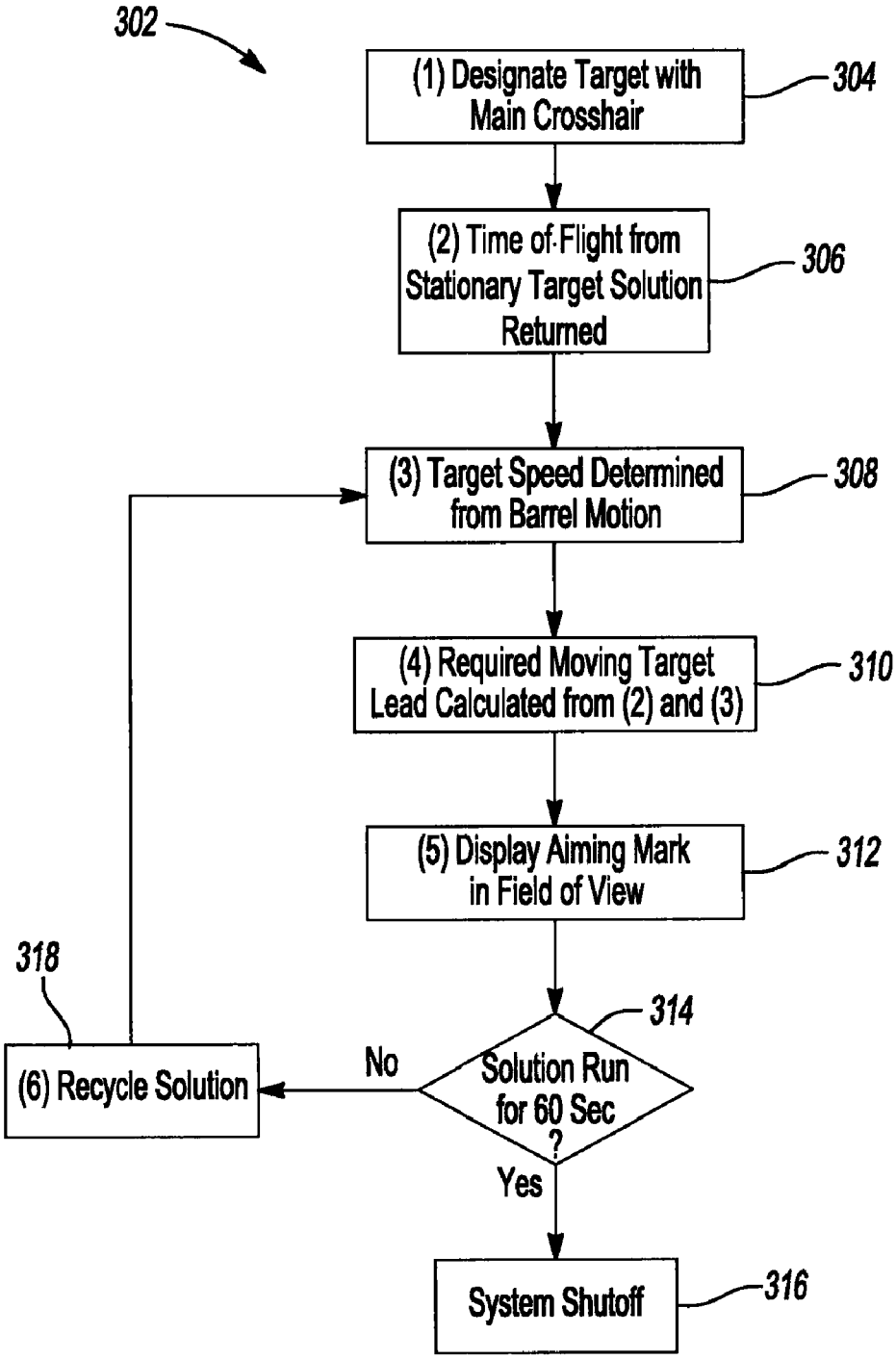
FIG. 18 is a flowchart detailing operation of the aiming system of FIG. 9 in a moving-target mode.

As described above, the aiming system 200 may be used in conjunction with a stationary target and/or a moving target. Once the stationary-target solution is determined at 293 (FIG. 13), the processor 202 may determine a moving-target solution if the motion sensor 234 indicates that the barrel 19 of the firearm 20 is moving. Such movement of the barrel 19 of the firearm 20—as detected by the motion sensor 234—may indicate to the processor 202 that the user is sweeping the firearm 20 and tracking a moving target at 300. The processor 202 may utilize a moving-target algorithm to determine the moving-target solution. The moving-target algorithm is shown in FIG. 18 as reference numeral 302 and will be described in greater detail with respect to FIG. 18.

As with the stationary-target solution, the moving-target solution is initiated when the target is aligned with the reticle 22 and the engage button 220 is depressed at 304. The processor 202 returns the stationary-target solution at 293 (FIG. 13) and a time of flight ($t_{tof}$) of the projectile 21 is determined based on the stationary-target solution at 306. A speed of the barrel 19 of the firearm 20 may be determined at 308 based on information received from the motion sensor 234. Specifically, the change in barrel yaw, as indicated by the yaw rate gyroscope 237 and digital compass 239 of the motion sensor 234 over time (i.e., $d\psi/dt$) and target range may be used to calculate the target speed or target crosstrack speed (Vtgt). The crosstrack speed and time of flight of the projectile 21 may then be used to calculate an angular target lead ($\psi_{lead}$) at 310.

Once the required moving target lead is determined based on the time of flight of the projectile 21 and the target crosstrack speed of the target, the processor 202 may display the corrected-aiming point 218 in the field-of-view 185 at 312. The corrected-aiming point 218 may include a different shape, color, or configuration than the stationary-corrected aiming point 218 to differentiate between the stationary-target solution and the moving-target solution. Because the stationary-target solution is required to determine the moving-target solution, the stationary-target solution is determined before the moving-target solution. As such, the stationary-target solution can be displayed along with the moving-target solution to allow a user to rely on the stationary-target solution and the moving-target solution simultaneously and allow the user to switch between the stationary-target solution and the moving-target solution. Allowing the corrected-aiming point 218 to include a different shape, color, or configuration between the stationary-target solution and the moving-target solution allows the user to quickly differentiate between the stationary-target solution and the moving-target solution.

The corrected-aiming point 218 may be a dynamic aiming point or static grid including designated speeds to allow the user to continually track a moving target. Specifically, the corrected-aiming point 218 may dynamically adjust based on the speed with which the firearm 20 is moved to allow the corrected-aiming point 218 to provide the user with an accurate angular target lead.

Once the corrected-aiming point 218 is displayed, the processor 202 determines at 314 whether the corrected-aiming point 218 has been displayed for greater than sixty seconds. If the corrected-aiming point 218 is displayed for greater than sixty (60) seconds, the processor 202 removes the corrected-aiming point 218 from the field-of-view 185 at 316. If the corrected-aiming point 218 has been displayed for approximately less than sixty (60) seconds, the solution is recycled at 318 and the calculations are allowed to continue to run to continually update a position of the corrected-aiming point 218 based on a speed of movement of the firearm 20, as detected by the motion sensor 234 and determined by the processor 202. While the corrected-aiming point 218 is described as being displayed for sixty (60) seconds, sixty (60) seconds is exemplary and, as such, the corrected-aiming point 218 could be displayed for more than or less than sixty (60) seconds.

The processor 202 continues to determine the moving-target solution at 320 (FIG. 13) provided the motion sensor 234 indicates that the firearm 20 is being moved and will continue to display the corrected-aiming point 218 on the display 206 at 296 (FIG. 13) until the motion sensor 234 indicates that the firearm 20 is not being moved or the solution has been run for greater than approximately sixty seconds.

With particular reference to FIGS. 19-28, the aiming system 200 is shown in conjunction with an optical sight 400 having a housing 402, an optics train 404, and an adjustment system 406. As described above with respect to the optical sight 10, the housing 402 may be selectively attached to a firearm 20 and may support the optics train 404 and adjustment system 406. The optics train 404 cooperates with the housing 402 to provide a magnified image of a target while the adjustment system 406 positions the optics train 404 relative to the housing 402 to properly align the optics train 404 relative to the firearm 20.

In view of the substantial similarity in structure and function of the components associated with the optics train 14 and adjustment system 16 with respect to the optics train 404 and adjustment system 406, respectively, like reference numerals are used hereinafter and in the drawings to identify like components. Because the optics train 404 is virtually identical to the optics train 14 and the adjustment system 406 is virtually identical to the adjustment system 16, a detailed description of the optics train 404 and adjustment system 406 is foregone.

The housing 402 may include a main body 408 and an eyepiece 410. The main body 408 may be attached to the eyepiece 410 such that when the main body 408 is attached to the eyepiece 410, an arcuate surface 411 (FIG. 20) is formed therebetween in a similar fashion with respect to arcuate surface 66 of optical sight 10. The main body 408 may additionally include a series of threaded bores 412 (FIG. 20), an inner cavity 414, a recess 416, an opening 418, and a battery cavity 420 (FIG. 21).

The threaded bores 412 may be disposed proximate to a bottom portion of the main body 408 and may be formed in a separable plate 422 that is selectively removed from the main body 408 to provide access to the recess 416. The inner cavity 414 may extend substantially along a length of the main body 408 and may receive the optics train 404 therein. The opening 418 may be formed adjacent to a side surface 424 (FIGS. 23 and 24) and on an opposite side of the main body 408 from the battery cavity 420, as best shown in FIG. 21. The side surface 424 may include a series of threaded bores 426 that selectively receive a series of fasteners 428 to attach a housing 430 to the main body 408. The housing 430 may extend from the side surface 424 of the main body 408 and may contain the range sensor 226 therein. In one configuration, the range sensor 226 may be a so-called "laser-range finder," which may be disposed proximate to the opening 418 of the main body 408 and may be contained generally within the housing 430.

The recess 416 may be formed at a bottom portion of the main body 408 opposite the selector buttons 223 and may receive a portion of the aiming system 200 therein. Specifically, the recess 416 may receive the processor 202 and memory 202 therein. In one configuration, the components of the processor 202 and memory 204 take the form of a printed circuit board (PCB) 432, which extends at least partially into the recess 416. During assembly, the PCB 432 may be inserted into the recess 416 and may be held in place by attaching the plate 422 to the main body 408 by a series of fasteners (not shown) received within threaded bores 434 of the main body 408 that are spaced apart and around a perimeter of an opening 436 of the main body 408 proximate to the recess 416.

Figure 22:
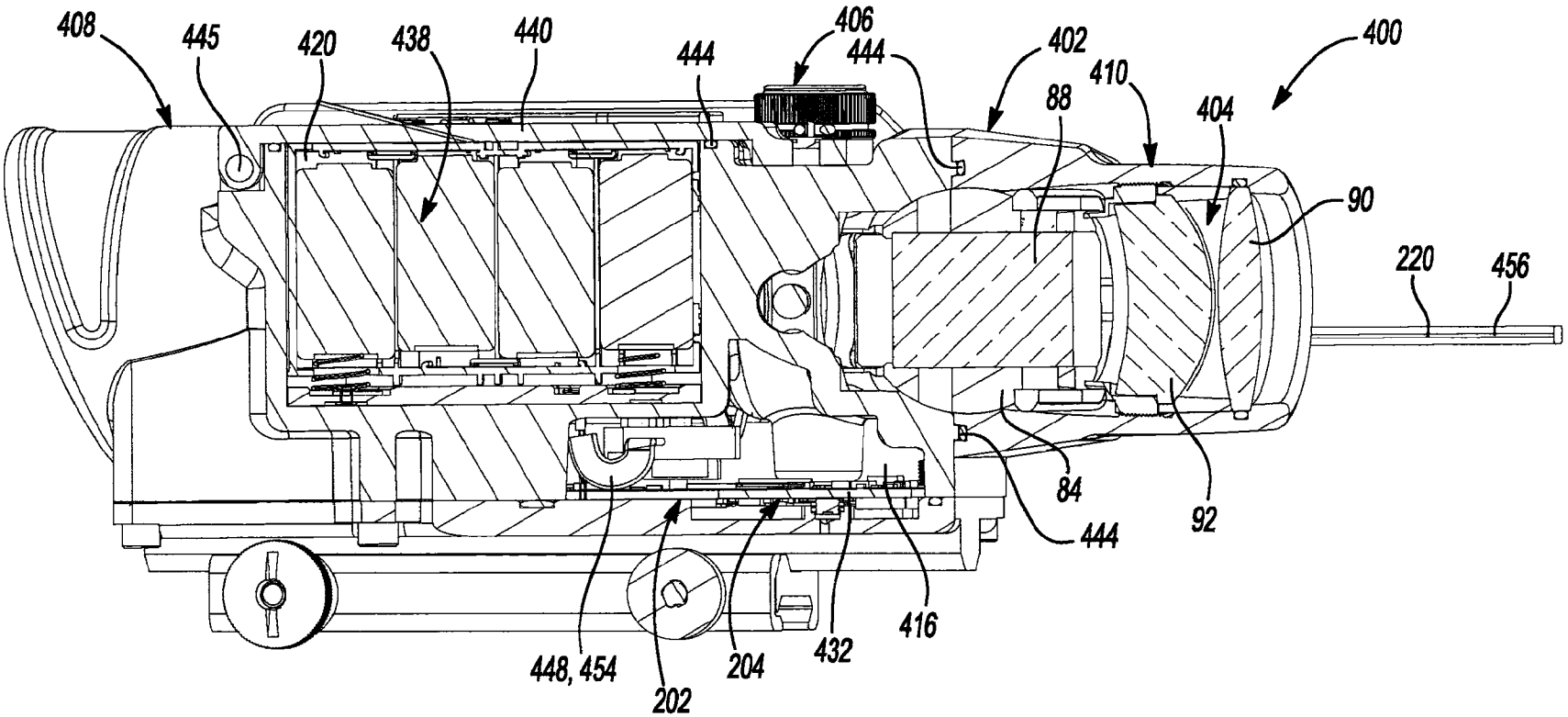
FIG. 22 is a cross-sectional view of the optical sight of FIG. 19 taken along line 22-22 of FIG. 19.

As described above, the battery cavity 420 is disposed generally on an opposite side of the main body 408 than the opening 418. The battery cavity 420 may receive a battery pack 438 therein and may include a cover 440 extending generally over the battery cavity 420. In one configuration, the cover 440 is attached to the main body 408 by a fastener 442 that, when removed from the housing 402, permits rotation of the cover 440 about a pivot 445 (FIG. 22). Rotation of the cover 440 about the pivot 445 and away from the main body 408 permits access to the battery cavity 420 and, thus, to the battery pack 438. Providing selective access to the battery cavity 420 allows a user to change the battery pack 438 should the batter pack 438 become faulty and require repair and/or replacement.

Figure 27:
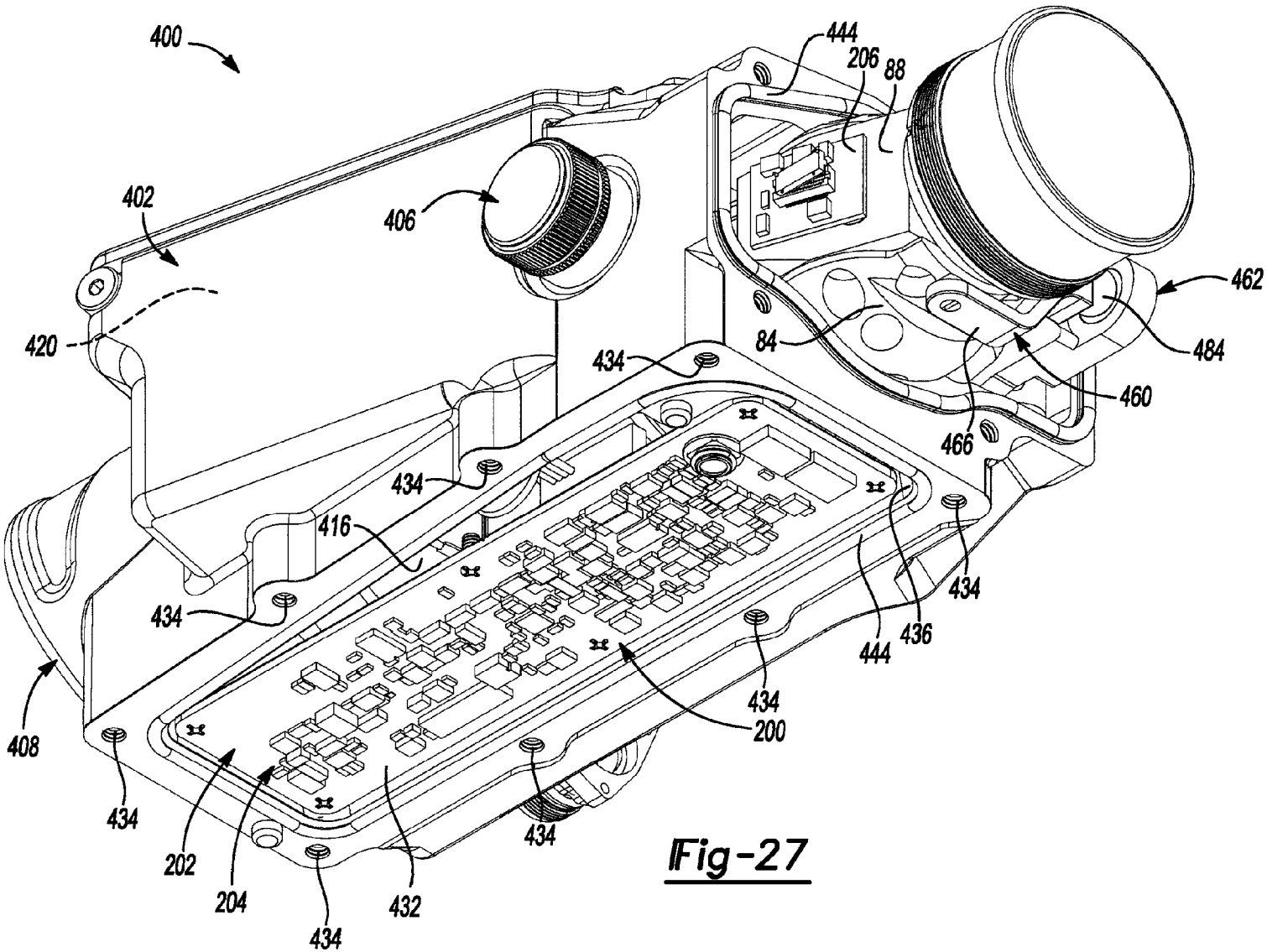
FIG. 27 is a perspective view of the optical sight of FIG. 19 with part of a housing removed to show internal components of the optical sight.
Figure 28:
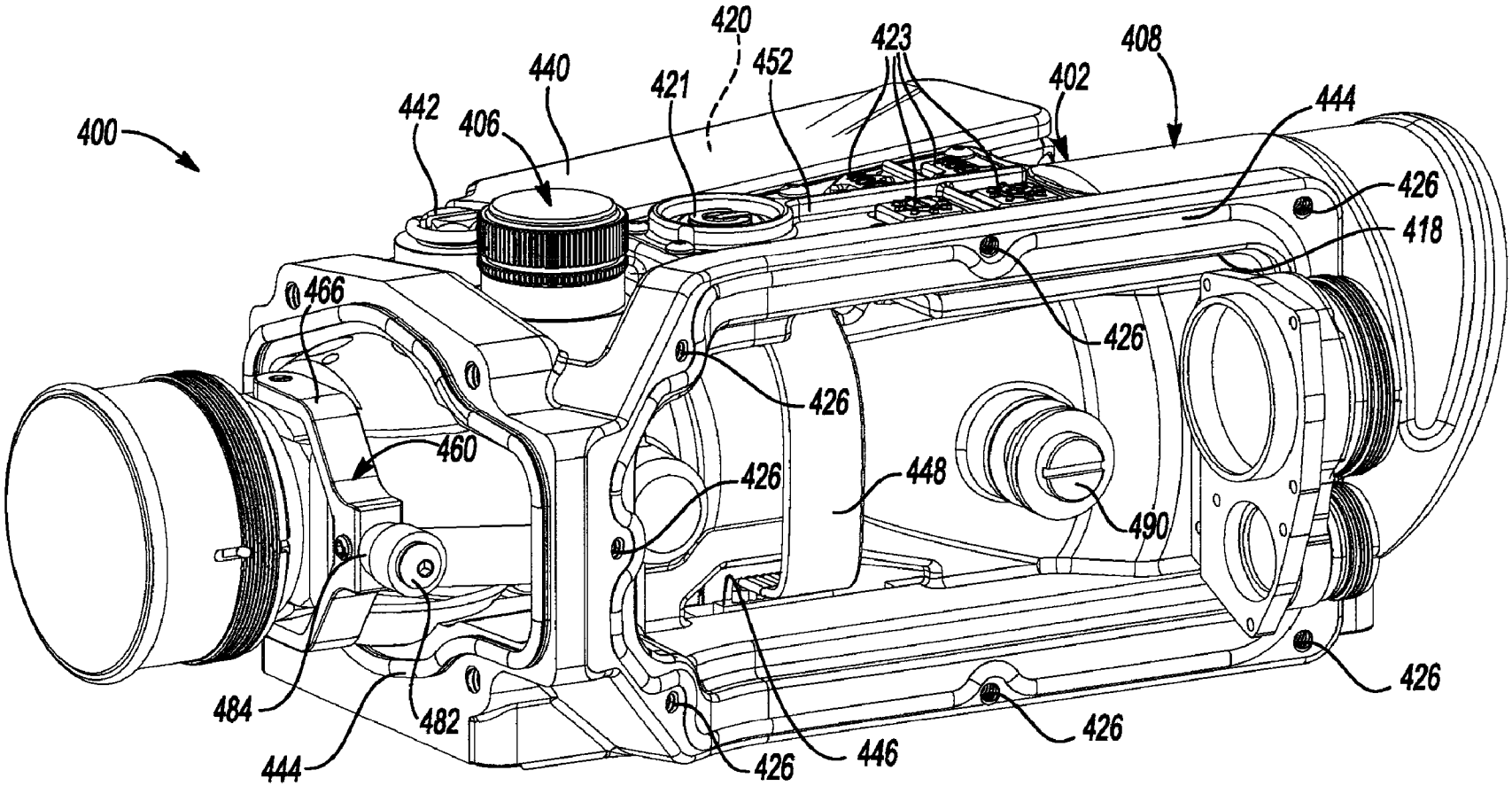
FIG. 28 is a perspective view of the optical sight of FIG. 19 with part of a housing removed to show internal components of the optical sight.

As described above, the main body 408 is described as being attached to the eyepiece 410, the plate 422, the housing 430, and the cover 440 at various locations. At each of these interfaces, a seal 444 may be positioned to prevent water or other debris from entering the main body 408. For example, as shown in FIG. 27, the seal 444 generally surrounds the opening of the housing 402 that provides access to the recess 416 to seal the interface between the main body 408 and the plate 422 when the plate 422 is attached to the main body 408. The seal 444 may be compressed between the main body 408 and the plate 422 when the plate 422 is attached to the main body 408 to prevent intrusion of water and other debris from entering the main body 408 at the recess 416. A similar seal 444 may likewise surround a perimeter of the opening 418 such that when the housing 430 is attached to the main body 408, the seal 444 is compressed and intrusion of water and other debris is restricted at an interface of the main body 408 and the housing 430.

With continued reference to FIGS. 19-28, incorporation of the aiming system 200 into the housing 402 will be described in detail. The aiming system 200 may be supported by the housing 402 at various locations and may be accessed by removing the plate 422 and/or housing 430 from the main body 408. During assembly, the PCB 432 may be received proximate to a bottom portion of the main body 408 and may be received within the recess 416, as described above. The PCB 432 may be in communication with the selector buttons 223 and various sensors 226, 228, 230, 232, 233, 234, 235, 237, 239 via a pin connector 446 (FIGS. 20 and 28), which may be attached to a cable 448 that extends to the selector buttons 223 and/or to the various sensors 226, 228, 230, 232, 233, 234, 235, 237, 239.

For example, the cable 448 may extend toward the selector buttons 223 and may be attached to a printed circuit board (PCB) 450 to allow the processor 202 to receive information from the selector buttons 223 when depressed. In operation, when a force is applied to the selector buttons 223—which may be formed from a suitable material such as, for example, rubber—the buttons 223 may be depressed relative to a rigid plate 452 generally surrounding the buttons 223 to engage dome switches (not shown) associated with the PCB 450. Depression of the dome switches provides a tactile response to the user that the particular button 223 has been sufficiently depressed and also provides the PCB 432 with a user input.

The adjustment made by the user in depressing the selector button(s) 223 relative to the plate 452 causes a signal to be transmitted from the PCB 450 to the PCB 432 via the cable 448 and pin connector 446. The signal may be received by the processor 202 associated with the PCB 432 and may be used by the processor 202—in conjunction with information from the memory 204—in generating a corrected-aiming point 218, as described above. Such an input may relate to the desired brightness of the display 206 and/or the current wind conditions. Further, the input may additionally or alternatively transmit a signal from the ON/OFF 221 to the PCB 432 to provide power to the aiming system 200.

While the cable 448 is described as transmitting a signal from the selector buttons 223 to the PCB 432, the same cable 448 or an additional cable may be used to provide power from the battery pack 438 and/or information from any or all of the various sensors 226, 228, 230, 232, 233, 234, 235, 237, 239 to the PCB 432. For example, a portion of the cable 448 or an additional cable 454 (FIG. 22) may be routed from the PCB 432 to the battery pack 438 to allow the battery pack 438 to supply the PCB 432 with power. The cable 454 may also extend from the battery pack 438 to the range sensor 226 to likewise provide power to the range sensor 226 and/or to relay information from the range sensor 226 to the PCB 432 for use by the PCB 432 in generating the corrected-aiming point 218. While the battery pack 438 is described as providing power to the PCB 432 and range sensor 226, the battery pack 438 may provide power to any component of the optical sight 400 and/or aiming system 200 that relies on power to operate. Namely, the battery pack 438 may provide power to the display 206 to permit the display 206 to provide information to the user within the field-of-view 185.

With particular reference to FIG. 19, the engage button 220 is shown as being a tape switch 456 that is received by a portion of the housing 430. The tape switch 456 may provide a tactile response to a user such that when the user depresses the tape switch 456, a tactile response is provided to alert the user that the engage button 220 has been sufficiently depressed. Once the engage button 220 is depressed, information may be transmitted to the PCB 432 via one of the cables 448, 454 or via a separate cable (not shown) to alert the PCB 432 that a corrected-aiming point 218 is desired by the user, as described above.

As described, the PCB 432 may rely on various inputs from sensors 226, 228, 230, 232, 233, 234, 235, 237, 239 in generating the corrected-aiming point 218. Of the various sensors 226, 228, 230, 232, 233, 234, 235, 237, 239, a position of the range sensor 226 relative to the housing 402 should be adjusted when a position of the reticle 22 is adjusted relative to the housing 402 (via the adjustment system 406) to ensure the range sensor 226 maintains alignment with the reticle 22.

When a position of the reticle 22 is adjusted via the first adjuster assembly 102 and/or the second adjuster assembly 102' relative to the main body 408, a position of the range sensor 226 must also be adjusted in a similar fashion such that when the reticle 22 is aligned with a target and the tape switch 456 is depressed, the range identified by the range sensor 226 is aligned with the reticle 22 (i.e., a laser associated with the range sensor 226 is coincident with the reticle 22). Adjusting the reticle 22 relative to the main body 408 may be accomplished by manipulating the first adjuster assembly 102 and/or the second adjuster assembly 102' which, in turn, causes movement of the housing 84 and, thus, the roof prism 86 and mirror prism 88 relative to the main body 408. If a position of the reticle 22 is adjusted relative to the main body 408 via either or both of the first adjuster assembly 102 or second adjuster assembly 102' without concurrently moving the location at which the range sensor 226 measures a distance to a target, the point at which a user aligns the reticle 22 relative to a target will be offset from the point at which the range sensor 226 identifies the distance to the target. For example, if the reticle 22 is aligned with a door of a vehicle (neither shown), the location on the vehicle at which the range sensor 226 measures the distance from the optical sight 400 to the vehicle may be taken at another location on the vehicle other than the door, thereby providing the user and aiming system 200 with an inaccurate distance to the desired location on the target.

Figure 23:
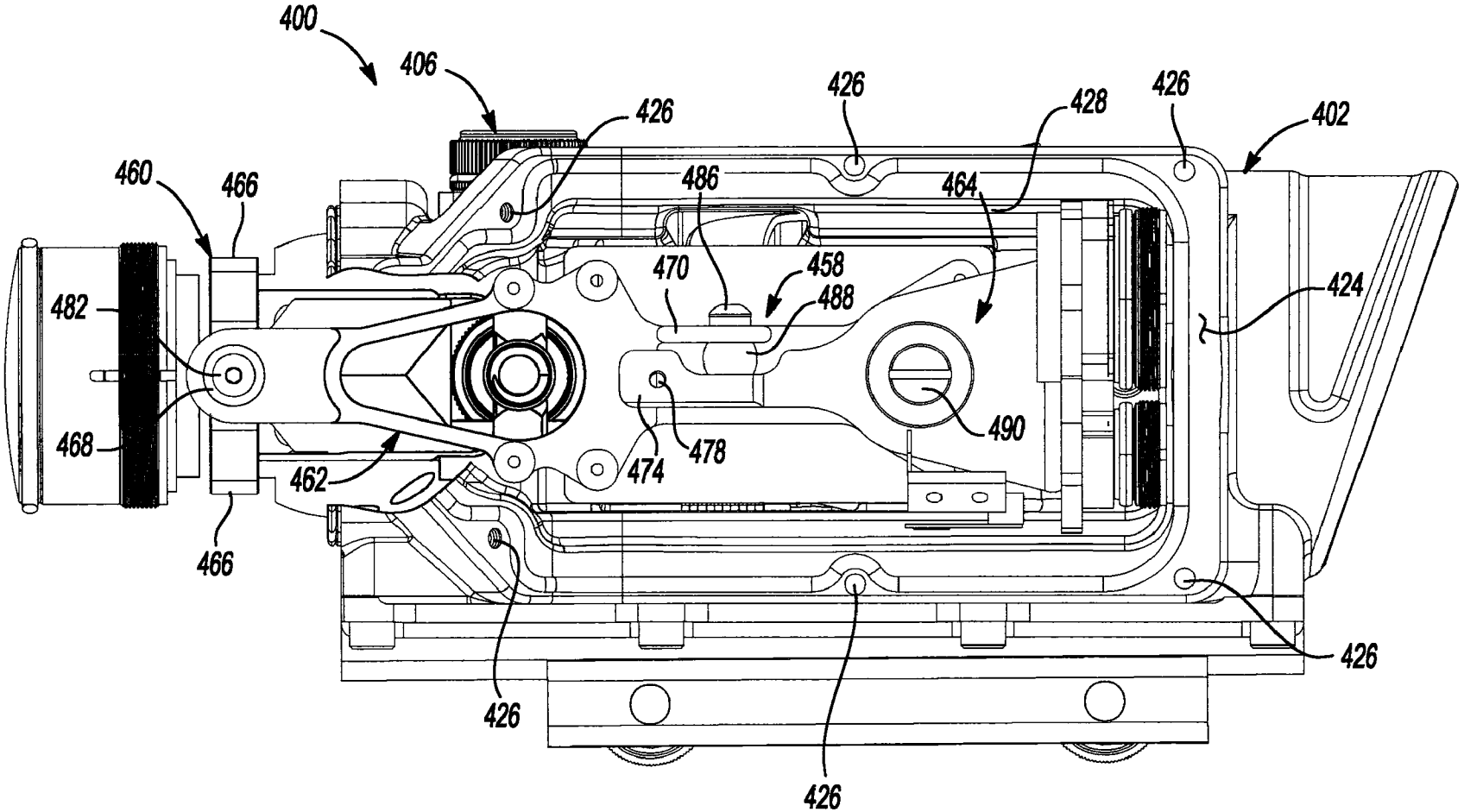
FIG. 23 is a side view of the optical sight of FIG. 19 with part of a housing removed to show internal components associated with the optical sight.
Figure 24:
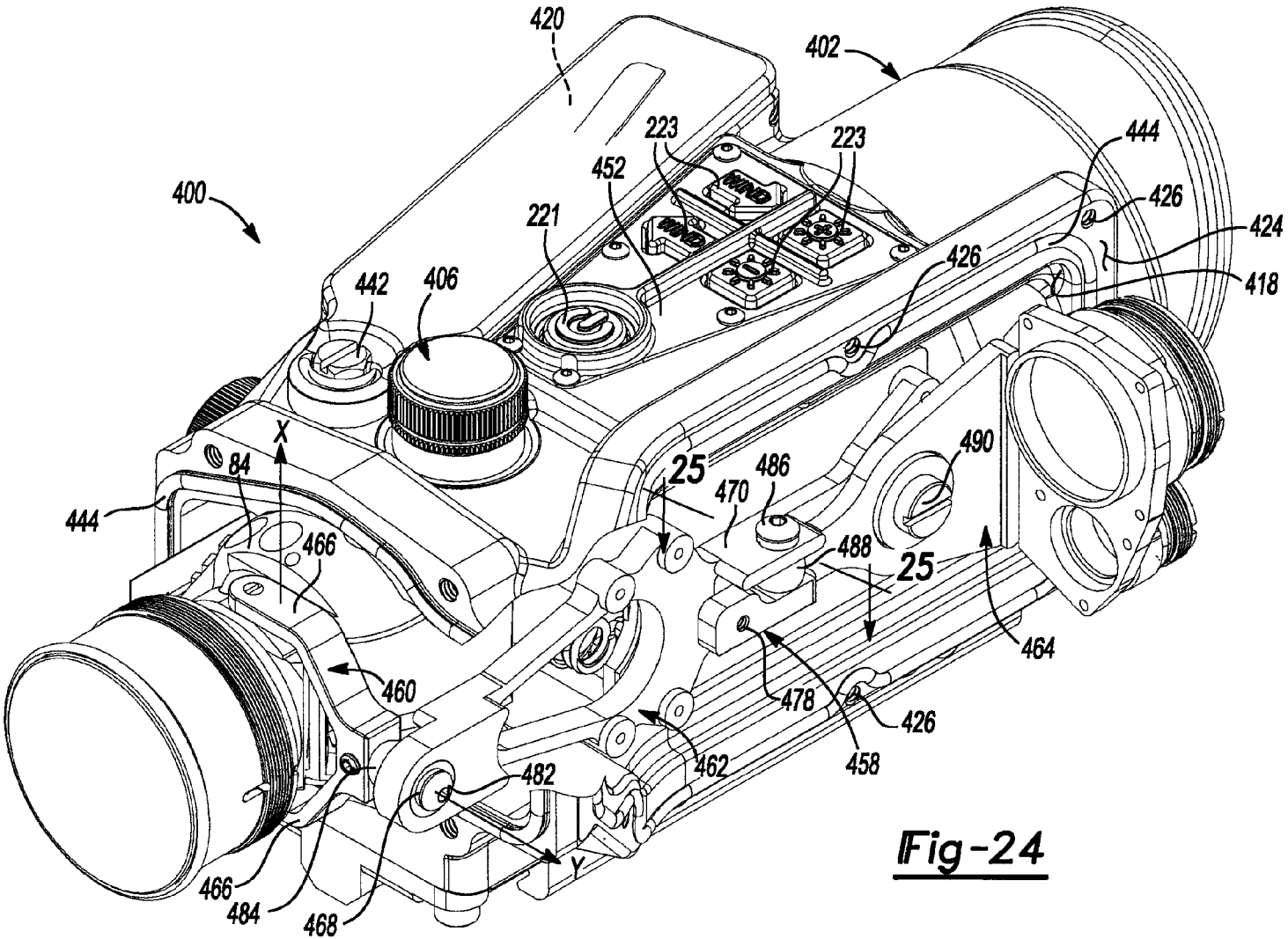
FIG. 24 is a perspective view of the optical sight of FIG. 19 with part of a housing removed to show internal components associated with the optical sight.
Figure 25:
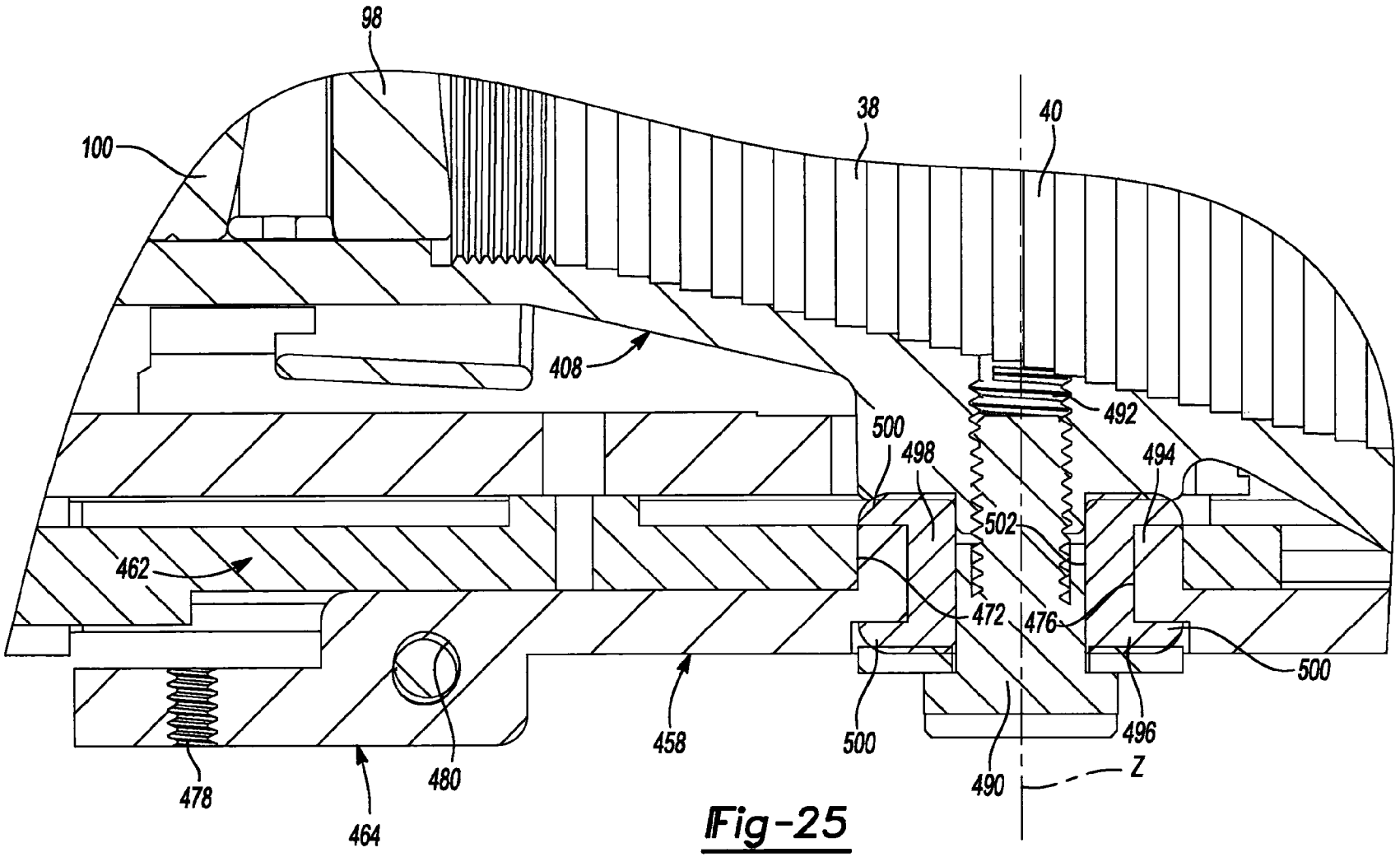
FIG. 25 is a partial sectional view of the optical sight of FIG. 19 taken along line 25-25 of FIG. 24.
Figure 26:
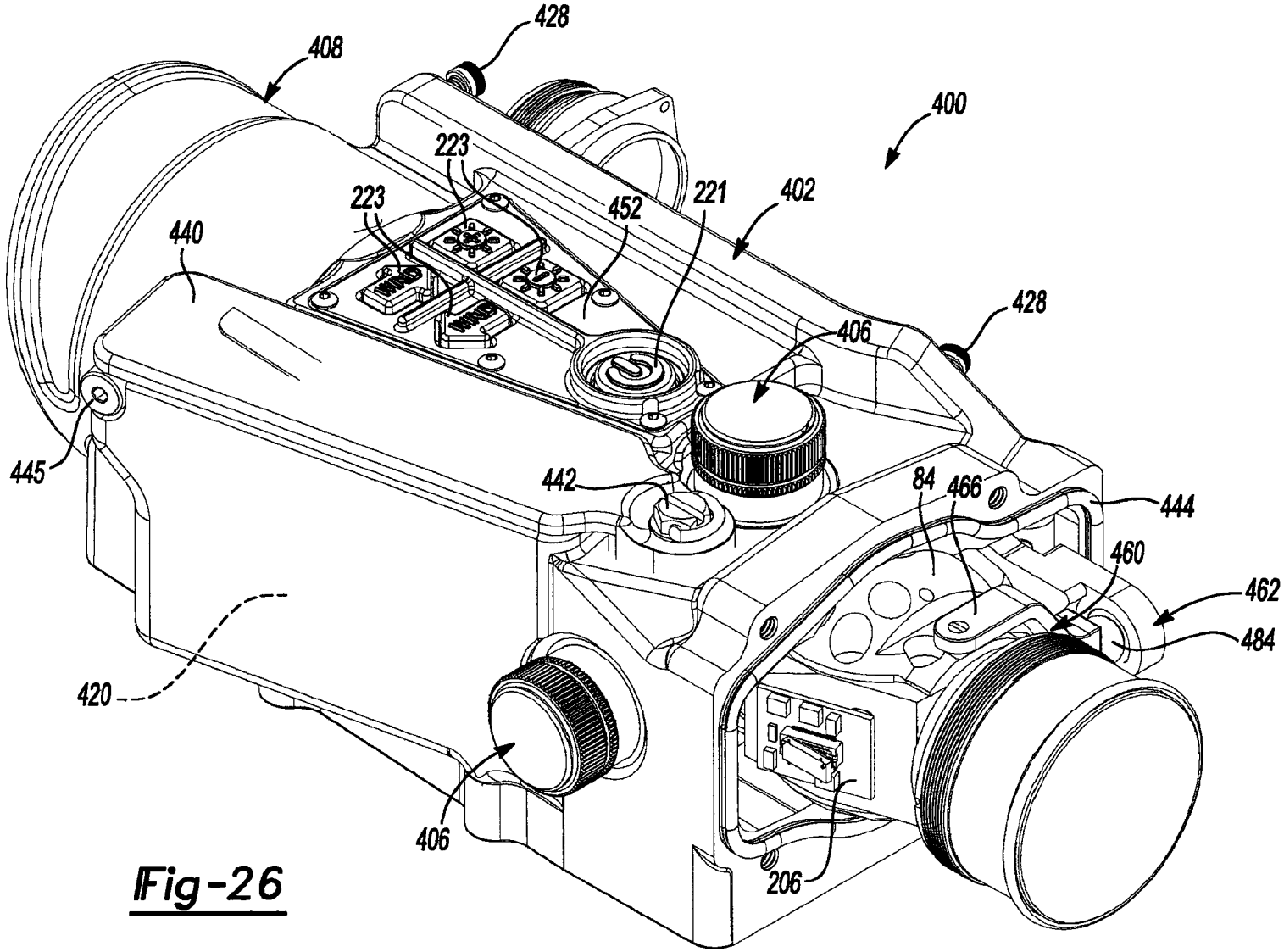
FIG. 26 is a partial perspective view of the optical sight of FIG. 19 with part of a housing removed to show internal components of the optical sight.

With particular reference to FIGS. 23-25, a linkage mechanism 458 is provided for coupling movement of the housing 84 and, thus, the reticle 22, with the range sensor 226. The linkage mechanism 458 may couple the housing 84 associated with the prisms 86, 88 to the range sensor 226 to adjust a position of the range sensor 226 when a position of the housing 84 is adjusted relative to the main body 408. The linkage mechanism 458 may include a coupling 460, a linkage 462, and a bracket 464. The coupling 460 may include a substantially Y-shape and may include a pair of arms 466 attached at opposite ends of the housing 84. The linkage 462 may extend in a direction substantially parallel to a longitudinal axis of the optical sight 400 and may include an attachment aperture 468, a projection 470, and a bore 472 (FIG. 25). The bracket 468 may be disposed proximate to a distal end of the linkage 462 and may include an arm 474 and a bore 478, whereby the arm 474 includes an attachment aperture 478 and an adjustment aperture 480 (FIG. 25).

The linkage 462 may extend generally between the coupling 460 and the bracket 464 and may serve to transmit a force applied to the coupling 460 via the housing 84 to the bracket 464. The linkage 462 may receive an adjustment fastener 482 to attach the linkage 462 to the coupling 460 at the attachment aperture 468 of the linkage 462. The adjustment fastener 482 may extend through the attachment aperture 468 of the linkage 462 and may be received within a threaded bore (not shown) of the coupling 460 to join the coupling 460 and the linkage 462. An elastomeric bushing 484 may be positioned generally between the coupling 460 and the linkage 462 such that when the adjustment fastener 482 is rotated relative to the linkage 462 to bring the linkage 462 into proximity to the coupling 460, the elastomeric bushing 484 is partially compressed therebetween.

The linkage 462 may be attached to the bracket 464 at the projection 470 of the linkage 462 and at the arm 474 of the bracket 464. Specifically, an adjustment fastener 486 may extend through an aperture (not shown) formed through the projection 470 and may be threadably received by the adjustment aperture 480 of the bracket 464. An elastomeric bushing 488 may be disposed generally between the projection 470 of the linkage 462 and the arm 474 of the bracket 464 and may be at least partially compressed when the adjustment fastener 486 is rotated relative to the projection 470 to move the linkage 462 toward the bracket 464 at the projection 470.

The linkage 462 and bracket 464 may be attached to the main body 408 via a fastener 490 (FIG. 25), which may be received within a threaded bore 492 of the main body 408. The fastener 490 may extend through the bore 472 of the linkage 462 and may likewise extend through the bore 476 of the bracket 464, as the bore 472 of the linkage 462 is substantially coaxially aligned with the bore 476 of the bracket 464.

As shown in FIG. 25, the bracket 464 may include a flange 494 axially surrounding the bore 476. The flange 494 may extend into and be received by the bore 472 of the linkage 462 such that the linkage 462 is permitted to rotate relative to the bracket 464 about the flange 494. A grommet 496 may be received between the fastener 490 and the flange 494 of the bracket 464 and may be at least partially compressed between the bracket 464 and the main body 408 when the fastener 490 is rotated into the threaded bore 492 and is moved toward the main body 408. In one configuration, the grommet 496 includes a main body 498 and a pair of extensions 500. The main body 498 may include a bore 502 extending therethrough that receives the fastener 490 with the extensions 500 projecting outwardly from the main body 498 and away from the bore 502. The extensions 500 may be sized such that the flange 494 is received generally within the extensions 500 and proximate to the main body 498, as shown in FIG. 25.

With continued reference to FIGS. 23-25, operation of the linkage mechanism 458 will be described in detail. When a force is applied to the housing 84 via the adjustment system 406 to adjust a position of the reticle 22 relative to the main body 408, the housing 84 associated with the prisms 86, 88 and, thus, associated with the reticle 22, is adjusted relative to the main body 408. The housing 84 may be adjusted along an (X) axis and/or along a (Y) axis (FIG. 24) to adjust a position of the reticle 22 along either or both of the (X) and (Y) axes. Movement of the housing 84 causes concurrent movement of the coupling 460, as the coupling 460 is attached to the housing 84 at the arms 466 of the coupling 460.

Movement of the coupling 460 likewise causes movement of the linkage 462, as the linkage 462 is attached to the coupling 460 by the fastener 482. Such movement likewise causes movement of the bracket 464, as the bracket 464 is attached to the linkage 462 at the projection 470 of the linkage 462 and the arm 474 of the bracket 464 via the fastener 486. Because the bracket 464 may be attached to the range sensor 226 at the attachment aperture 478, movement of the bracket 464 relative to the main body 408 likewise causes movement of the range sensor 226 relative to the main body 408. Therefore, when the housing 84 and, thus, a position of the reticle 22, is adjusted relative to the main body 408, a position of the range sensor 226 is likewise adjusted relative to the main body 408. As such, when the reticle 22 is positioned relative to a target, the range sensor 226 is likewise positioned relative to the target such that the range to the target is taken at approximately the same location that the reticle 22 is positioned on the target.

During manufacturing, a position of the reticle 22 relative to the range sensor 226 may be adjusted by adjusting either or both of fasteners 482, 486. Rotation of fastener 482 causes movement of the linkage 462 and, thus, the bracket 464, along the (Y) axis such that the linkage 462 is moved towards or away from the coupling 460. Specifically, as the fastener 482 is rotated toward the coupling 460, the elastomeric bushing 484 is compressed and the linkage 462 is moved closer to the coupling 460. Conversely, rotation of the fastener 482 away from the coupling 460 likewise causes less compression of the elastomeric bushing 484 and results in the linkage 462 similarly moving away from the coupling 460.

Because the linkage 462 is attached to the bracket 464, movement of the linkage 462 toward or away from the coupling 460 along the (Y) axis likewise causes movement of the bracket 464. Such movement is transferred from the linkage 462 to the bracket 464 due to attachment of the linkage 462 to the bracket 464 by the fastener 486 at the projection 470 of the linkage 462 and the arm 474 of the bracket 464.

Movement of the linkage 462 and the bracket 464 along the (Y) axis essentially causes pivotal movement of the linkage 462 and bracket 464 about a center of the fastener 490 (FIG. 25; represented by axis (Z) passing through the center of the fastener 490). Because the bore 472 of the linkage 462 and the bore 476 of the bracket 464 are larger than an outer diameter of the fastener 490 and, further, because the fastener 490 is spaced apart and separated from the linkage 462 and bracket 464 by the grommet 496, pivotable movement of the linkage 462 and bracket 464 relative to the main body 408 and fastener 490 is permitted. Specifically, as a force is applied to the linkage 462 and bracket 464 caused by rotation of the fastener 482 such that the linkage 462 and bracket 464 are caused to pivot at the fastener 490, the grommet 496 may be compressed by the flange 494 of the bracket 464, thereby permitting such pivotable movement of the linkage 462 and bracket 464.

In addition to adjustment of the linkage 462 and bracket 464 in a direction along the (Y) axis, a similar adjustment may be made along the (X) axis during manufacturing of the optical sight 400. Specifically, the fastener 486 may be rotated relative to the projection 470 of the linkage 462 to move the arm 474 of the bracket 464 toward or away from the projection 470. Such rotation of the fastener 486 and the resulting movement of the arm 474 of the bracket 464 toward or away from the projection 470 results in the bracket 464 rotating about the main body 498 of the grommet 496, thereby causing movement of the attachment aperture 478 and, thus, the range sensor 226, along the (X) axis. Once a position of the range sensor 226 is sufficiently adjusted such that a position of the reticle 22 is aligned with a location at which the range sensor 226 determines a range to a target, further rotation of the fasteners 482, 486 is not performed and the housing 430 is secured to the main body 408.

If, during use, a position of the reticle 22 is adjusted along either or both of the (X) and (Y) axes to zero or otherwise calibrate the optical sight 400 to a firearm 200, a position of the range sensor 226 is likewise adjusted. Specifically, as the housing 84 is moved in either or both of the (X) and (Y) axes, the position of the range sensor 226 is likewise adjusted due to interaction of the coupling 460, linkage 462, and bracket 464 to ensure that the range-to-target is taken at a position of the target where the reticle 22 is aligned.

Aligning the reticle 22 and a position at which the range sensor 226 determines a range-to-target allows the aiming system 200 to accurately provide the user with the corrected-aiming point 218. As described above, when a user desires a corrected-aiming point 218, the user depresses the engage button 220 by depressing the tape switch 456, thereby causing the PCB 432 to pull the sensors 226, 228, 230, 232, 233, 234, 235, 237, 239 to generate the corrected-aiming point 218. Because the user depresses the engage button 220 when the reticle 22 is trained on a target, the range obtained by the PCB 432 is the range to the desired target. Such a range can only be determined by the range sensor 226 if the range sensor 226 is properly aligned with the reticle 22. Therefore, maintaining alignment of the reticle 22 and the range sensor 226 throughout adjustment of the reticle 22 relative to the main body 408 allows the PCB 432 to generate an accurate corrected-aiming point 218 when a user depresses the engage button 220 via the tape switch 456.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An aiming system for use with a weapon, the aiming system comprising:

a processor;

at least one sensor in communication with said processor;

a memory in communication with said processor; and a display in communication with said processor and operable to display a corrected-aiming point based on at least one simulated bullet trajectory and at least one simulated bullet impact location determined by said processor, said processor using closed-loop control to generate said corrected-aiming point by iteratively generating said simulated bullet trajectory and said simulated bullet impact location until said simulated bullet impact location impacts a desired target at a desired location.

2. The aiming system of claim 1, wherein said at least one sensor includes a range sensor, a wind sensor, a tilt sensor, a pressure sensor, a temperature sensor, a yaw-rate gyroscope, and a digital compass.

3. The aiming system of claim 1, wherein said memory stores at least one of geometric data of at least one projectile, a relationship of mach number versus drag coefficient, weapon-type data, and projectile-type data.

4. The aiming system of claim 3, wherein said relationship is at least one of a plot of mach number versus drag coefficient and a look-up table of mach numbers and corresponding drag coefficients.

5. The aiming system of claim 1, wherein said display is one of a light-emitting diode (LED) display, an organic light-emitting diode (OLED) display, or a liquid-crystal display (LCD).

6. The aiming system of claim 1, wherein said display simultaneously displays at least two corrected-aiming points having at least one of a different shape, a different color, and a different configuration.

7. The aiming system of claim 1, wherein said processor is operable to generate a moving corrected-aiming point for a moving target based on said corrected-aiming point, said processor operable to simultaneously display said moving corrected-aiming point along with said corrected-aiming point.

8. A method comprising:

aligning a weapon with a desired target;

energizing an aiming system associated with said weapon;

determining a range to said target;

generating by a processor a number of simulated bullet trajectories;

generating by said processor a number of simulated bullet impact locations;

generating by said processor said simulated bullet trajectories and said simulated bullet impact locations using closed-loop control until an error between said simulated bullet impact location and said target is within a predetermined range; and generating a corrected-aiming point if said error is within said predetermined range to aid a shooter in adjusting a position of said weapon to allow a projectile fired from said weapon to contact said target at a desired location.

9. The method of claim 8, wherein displaying said corrected-aiming point includes displaying said corrected-aiming point in a field-of-view of the shooter.

10. The method of claim 8, wherein generating said corrected-aiming point includes generating a static corrected-aiming point for a static target.

11. The method of claim 10, further comprising generating a moving corrected-aiming point for a moving target based on said static corrected-aiming point.

12. The method of claim 11, further comprising simultaneously displaying said static corrected-aiming point and said moving corrected-aiming point.

13. The method of claim 12, wherein displaying said static corrected-aiming point and said moving corrected-aiming point includes displaying two different indicia.

14. The method of claim 12, wherein displaying said static corrected-aiming point and said moving corrected-aiming point includes displaying indicia of at least one of a different color and a different shape to aid the shooter in distinguishing between said static corrected-aiming point and said moving corrected-aiming point.

15. A method comprising:

aligning a weapon with a static target;

energizing an aiming system associated with said weapon;

determining a range to said static target;

generating by a processor a static corrected-aiming point to aid a shooter in adjusting a position of said weapon to allow a projectile fired from said weapon to contact said static target at a desired location;

detecting movement of said static target;

generating by said processor a moving corrected-aiming point based on said static corrected-aiming point to aid the shooter in adjusting a position of said weapon to allow a projective fired from said weapon to contact said moving target at a desired location; and simultaneously displaying said static corrected-aiming point and said moving corrected-aiming point.

16. The method of claim 15, wherein detecting movement of said target includes detecting movement of said weapon.

17. The method of claim 16, wherein detecting movement of said weapon includes receiving information from a yaw-rate sensor.

18. The method of claim 16, wherein generating said static corrected-aiming point includes determining a simulated bullet trajectory and a simulated bullet impact location.

19. The method of claim 18, wherein generating said static corrected-aiming point includes iteratively generating said simulated bullet trajectory and said simulated bullet impact location until said simulated bullet impact location impacts said static target at a desired location.

20. The method of claim 15, wherein displaying said static corrected-aiming point and said moving corrected-aiming point includes displaying two different indicia.

21. The method of claim 15, wherein displaying said static corrected-aiming point and said moving corrected-aiming point includes displaying indicia of at least one of a different color and a different shape to aid the shooter in distinguishing between said static corrected-aiming point and said moving corrected-aiming point.

* * * * *